US010086608B2

(12) United States Patent
Sato et al.

(10) Patent No.: US 10,086,608 B2
(45) Date of Patent: Oct. 2, 2018

(54) INK-JET RECORDING APPARATUS

(71) Applicant: BROTHER KOGYO KABUSHIKI KAISHA, Nagoya-shi, Aichi-ken (JP)

(72) Inventors: Shoji Sato, Okazaki (JP); Keisuke Yamamoto, Nagoya (JP); Kenji Kawamoto, Nagoya (JP); Satoru Arakane, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/697,533

(22) Filed: Sep. 7, 2017

(65) Prior Publication Data

US 2018/0072057 A1 Mar. 15, 2018

(30) Foreign Application Priority Data

Sep. 9, 2016 (JP) ..... 2016-177072

(51) Int. Cl.
*B41J 2/045* (2006.01)
*B41J 2/14* (2006.01)

(52) U.S. Cl.
CPC ..... *B41J 2/04596* (2013.01); *B41J 2/04533* (2013.01); *B41J 2/04541* (2013.01); *B41J 2/04573* (2013.01); *B41J 2/04581* (2013.01); *B41J 2/04555* (2013.01); *B41J 2/04595* (2013.01); *B41J 2002/14217* (2013.01); *B41J 2002/14225* (2013.01)

(58) Field of Classification Search
CPC ..... B41J 2/04596; B41J 2/04533; B41J 2/04541; B41J 2/04573; B41J 2/04581; B41J 2/04555; B41J 2/04595; B41J 2/14225; B41J 2/14217
See application file for complete search history.

(56) References Cited

U.S. PATENT DOCUMENTS

2003/0043926 A1* 3/2003 Terashima ..... H04L 7/0012 375/257
2011/0158299 A1 6/2011 Yamazaki

FOREIGN PATENT DOCUMENTS

| | | | |
|---|---|---|---|
| JP | 2011-139246 | A | 7/2011 |
| JP | 2011-251419 | A | 12/2011 |
| JP | 2013-226765 | A | 11/2013 |
| JP | 2015-101048 | A | 6/2015 |

* cited by examiner

*Primary Examiner* — Thinh H Nguyen
(74) *Attorney, Agent, or Firm* — Scully, Scott, Murphy & Presser, PC

(57) ABSTRACT

An ink-jet recording apparatus includes: a conveyor conveying a sheet; a recording head including first nozzles, second nozzles, first driving elements corresponding to the first nozzles respectively, and second driving elements corresponding to the second nozzles respectively; a controller; and a head driving circuit connected to the controller by first and second signal lines and a third signal line through which a clock signal is transmitted, and connected electrically to the first driving elements and the second driving elements. Each of the first and second driving elements is driven to jet an ink droplet from one of the first and second nozzles when driving voltage is applied from the head driving circuit. The controller repeatedly executes conveyance processing for conveying the sheet with the conveyor and recording processing in which pattern signals indicating patterns of the driving voltage are outputted serially and a jetting instruction signal is outputted serially.

13 Claims, 17 Drawing Sheets

Fig. 12

| | SIN0 | SIN1 | SIN2 | SIN3 | SIN4 | SIN5 | SIN6 | SIN7 |
|---|---|---|---|---|---|---|---|---|
| A | Nozzle K1 | Nozzle K2 | LOW | LOW | LOW | LOW | LOW | LOW |
| | | | LOW | LOW | LOW | LOW | LOW | LOW |
| | | | LOW | LOW | LOW | LOW | LOW | LOW |
| B | Nozzle K3 | Nozzle K4 | Nozzle Y1 | Nozzle Y2 | LOW | LOW | LOW | LOW |
| | | | | | LOW | LOW | LOW | LOW |
| | | | | | LOW | LOW | LOW | LOW |
| C | Nozzle K5 | Nozzle K6 | Nozzle Y3 | Nozzle Y4 | Nozzle C1 | Nozzle C2 | LOW | LOW |
| | | | | | | | LOW | LOW |
| | | | | | | | LOW | LOW |
| D | LOW | Nozzle K7 | Nozzle Y5 | Nozzle Y6 | Nozzle C3 | Nozzle C4 | Nozzle M1 | Nozzle M2 |
| | LOW | | | | | | | |
| | LOW | | | | | | | |
| E | Nozzle K8 | Nozzle K9 | LOW | Nozzle Y7 | Nozzle C5 | Nozzle C6 | Nozzle M3 | Nozzle M4 |
| | | | LOW | | | | | |
| | | | LOW | | | | | |
| F | Nozzle K10 | Nozzle K11 | Nozzle Y8 | Nozzle Y9 | LOW | Nozzle C7 | Nozzle M5 | Nozzle M6 |
| | | | | | LOW | | | |
| | | | | | LOW | | | |
| G | LOW | Nozzle K12 | Nozzle Y10 | Nozzle Y11 | Nozzle C8 | Nozzle C9 | LOW | Nozzle M7 |
| | RSV | | | | | | LOW | |
| | RSV | | | | | | LOW | |
| H | RSV | Nozzle K13 | LOW | Nozzle Y12 | Nozzle C10 | Nozzle C11 | Nozzle M8 | Nozzle M9 |
| | HL | | RSV | | | | | |
| | RSV | | RSV | | | | | |
| I | RSV | Nozzle K14 | RSV | Nozzle Y13 | LOW | Nozzle C12 | Nozzle M10 | Nozzle M11 |
| | LOW | | RSV | | RSV | | | |
| | LOW | | RSV | | RSV | | | |
| J | LOW | Nozzle K15 | RSV | Nozzle Y14 | RSV | Nozzle C13 | LOW | Nozzle M12 |
| | LOW | | LOW | | RSV | | RSV | |
| | HIGH | | LOW | | RSV | | RSV | |
| K | HIGH | Nozzle K16 | LOW | Nozzle Y15 | RSV | Nozzle C14 | RSV | Nozzle M13 |
| | HIGH | | LOW | | LOW | | RSV | |
| | HIGH | | HIGH | | LOW | | RSV | |
| L | HIGH | Nozzle K17 | HIGH | Nozzle Y16 | LOW | Nozzle C15 | RSV | Nozzle M14 |
| | HIGH | | HIGH | | LOW | | LOW | |
| | HIGH | | HIGH | | HIGH | | LOW | |
| M | HIGH | Nozzle K18 | HIGH | Nozzle Y17 | HIGH | Nozzle C16 | LOW | Nozzle M15 |
| | HIGH | | HIGH | | HIGH | | LOW | |
| | HIGH | | HIGH | | HIGH | | HIGH | |
| N | HIGH | Nozzle K19 | HIGH | Nozzle Y18 | HIGH | Nozzle C17 | HIGH | Nozzle M16 |
| | HIGH | | HIGH | | HIGH | | HIGH | |
| | HIGH | | HIGH | | HIGH | | HIGH | |
| O | | | HIGH | Nozzle Y19 | HIGH | Nozzle C18 | HIGH | Nozzle M17 |
| | | | HIGH | | HIGH | | HIGH | |
| | | | HIGH | | HIGH | | HIGH | |
| P | | | | | HIGH | Nozzle C19 | HIGH | Nozzle M18 |
| | | | | | HIGH | | HIGH | |
| | | | | | HIGH | | HIGH | |
| Q | | | | | | | HIGH | Nozzle M19 |
| | | | | | | | HIGH | |
| | | | | | | | HIGH | |

INK-JET RECORDING APPARATUS

CROSS REFERENCE TO RELATED APPLICATION

The present application claims priority from Japanese Patent Application No. 2016-177072 filed on Sep. 9, 2016, the disclosure of which is incorporated herein by reference in its entirety.

BACKGROUND

Field of the Invention

The present invention relates to an ink-jet recording apparatus that records an image on a sheet by jetting ink.

Description of the Related Art

There is known an ink-jet recording apparatus including a controller that controls the whole apparatus and a recording head that mounts a head control circuit and nozzles (e.g., Japanese Patent Application Laid-open No. 2011-251419). The head control circuit causes ink to be jetted from each nozzle in response to an instruction from the controller, thereby recording an image on a sheet.

More specifically, the controller serially outputs a FIRE signal indicating patterns of driving voltage to be applied to each driving element, a SIN signal selecting one of the patterns included in the FIRE signal, and a CLK signal for synchronizing the FIRE signal and the SIN signal, to the head control circuit through different signal lines. The head control circuit converts the FIRE signal and the SIN signal in parallel in response to the CLK signal, and the driving voltage of the pattern selected by the converted SIN signal is applied in parallel to driving elements.

SUMMARY

In the ink-jet recording apparatus having the above configuration, for example, when noise is superimposed on a clock signal, the head control circuit can not properly recognize a boundary between the FIRE signal and the SIN signal that are transmitted serially. This causes ink not to be jetted from each nozzle properly, thus making it impossible to record a desired image on the sheet.

The present teaching has been made in view of the above circumstances, and an object of the present teaching is to provide an ink-jet recording apparatus that executes, at a proper timing, reset processing for allowing a head control circuit to recognize a front position (beginning) of a signal transmitted serially.

According to an aspect of the present teaching, there is provided an ink-jet recording apparatus, including:

a conveyor configured to convey a sheet in a conveyance direction, a recording head including first nozzles, second nozzles, first driving elements corresponding to the first nozzles respectively, and second driving elements corresponding to the second nozzles respectively;

a controller; and a head driving circuit connected to the controller by a first signal line, a second signal line, and a third signal line through which a clock signal is transmitted, the head driving circuit connected electrically to the first driving elements and the second driving elements, wherein each of the first driving elements is configured to be driven to jet an ink droplet from one of the first nozzles corresponding thereto in a case that driving voltage is applied from the head driving circuit to each of the first driving elements, each of the second driving elements is configured to be driven to jet an ink droplet from one of the second nozzles corresponding thereto in a case that driving voltage is applied from the head driving circuit to each of the second driving elements, the controller is configured to repeatedly execute conveyance processing and recording processing, the conveyance processing being processing in which the sheet is conveyed with the conveyor in a state where an area of the sheet for which the image is to be recorded faces the recording head, the recording processing being processing in which pattern signals indicating patterns of the driving voltage are outputted serially to the first signal line in synchronization with the clock signal and a jetting instruction signal is outputted serially to the second signal line in synchronization with the clock signal, in a case that the recording processing is executed multiple times, the controller is configured to execute reset processing at least once, the reset processing being processing in which a reset signal indicating a beginning of a new jetting instruction signal is outputted to the second signal line, the reset processing being executed between the recording processing executed twice successively, the jetting instruction signal includes first selection signals corresponding to the first driving elements respectively, second selection signals corresponding to the second driving elements respectively, a first output signal, and a second output signal, each of the first selection signals is used to select, from among the pattern signals, the driving voltage to be applied to the corresponding first driving element, each of the second selection signals is used to select, from among the pattern signals, the driving voltage to be applied to the corresponding second driving element, the first output signal indicates a timing at which the driving voltage is outputted to the first driving elements, the second output signal indicates a timing at which the driving voltage is outputted to the second driving elements, the head driving circuit is configured to repeatedly execute first extraction processing, second extraction processing, first application processing, and second application processing, the first extraction processing being processing in which the pattern signals inputted through the first signal line are extracted in response to the clock signal inputted through the third signal line;

the second extraction processing being processing in which the first selection signals, the second selection signals, the first output signal, the second output signal, and the reset signal inputted through the second signal line are extracted in response to the clock signal inputted through the third signal line;

the first application processing being processing in which, after extracting the first output signal, the driving voltage selected based on the first selection signals is applied in parallel to the first driving elements corresponding thereto, the second application processing being processing in which, after extracting the second output signal, the driving voltage selected based on the second selection signals is applied in parallel to the second driving elements corresponding thereto, and in the second extraction processing, the head driving circuit is configured to extract a signal inputted through the second signal line subsequent to the reset signal, as the beginning of the new jetting instruction signal.

In the above configuration, the timing at which the ink droplet is jetted from each of the first nozzles and the timing at which the ink droplet is jetted from each of the second nozzles may be controlled individually by use of the first output signal and the second output signal. Accordingly, ink droplets may be respectively jetted from the first nozzles and second nozzles at proper timings, for example, even when the first nozzles and the second nozzles have mutually different amounts of flying time of ink droplets elapsing from jetting thereof from the respective first and second nozzles to landing thereof on the sheet.

In the above configuration, however, it is not possible to reset the head driving circuit in a standby state of one of the first application processing and the second application processing (i.e., in a state where some of the selection signals are already extracted and the output signal is not yet extracted). Such a restriction can be solved by executing the reset processing at a timing between the recording processing executed twice successively, thereby allowing the head control circuit to recognize the front position (beginning) of a new jetting instruction signal without preventing image recording on the sheet.

BRIEF DESCRIPTION OF THE DRAWINGS

FIG. 12 schematically depicts selection signals SIN0 to SIN7.

DESCRIPTION OF THE EMBODIMENTS

Figure 1:
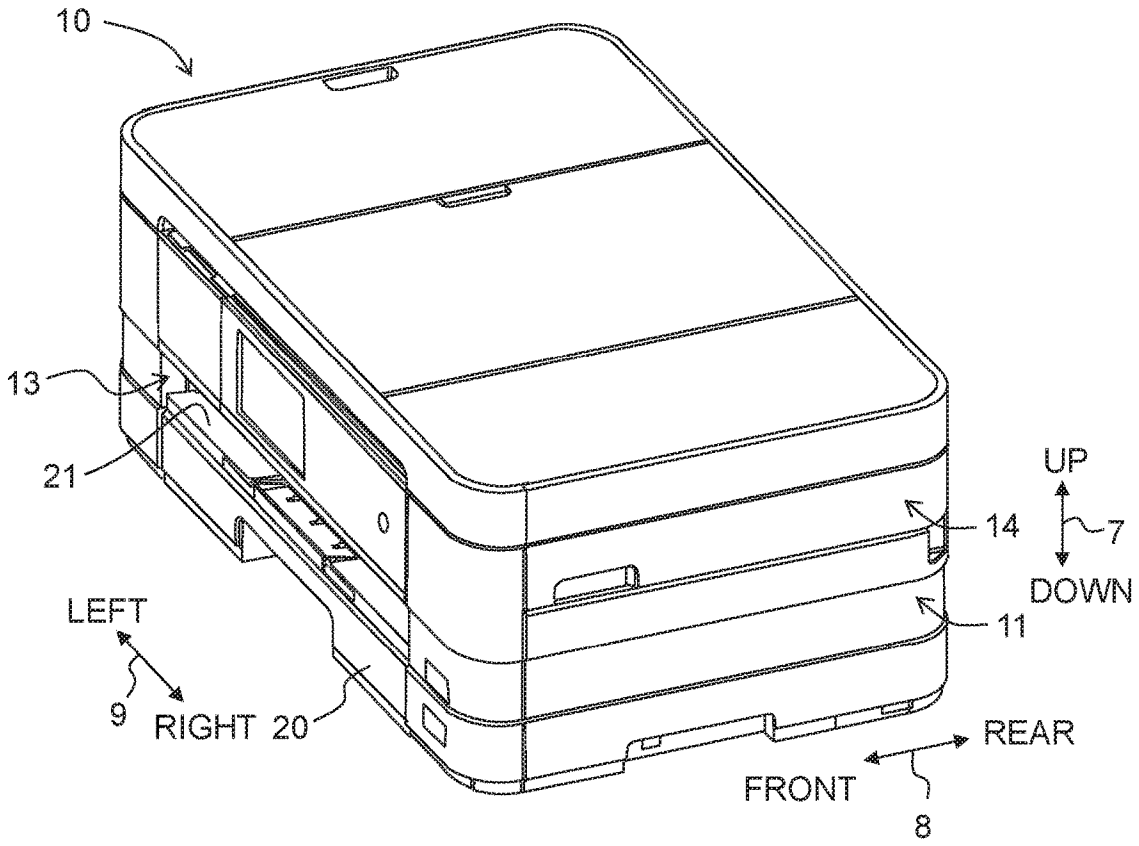
FIG. 1 is a perspective view of an external appearance of a multifunction peripheral.

An embodiment of the present teaching will be described below. Note that, the embodiment described below is merely an example of the present teaching; it goes without saying that it is possible to make any appropriate change(s) in the embodiment of the present teaching without departing from the gist and/or scope of the present teaching. In the following explanation, an up-down direction 7 is defined on the basis of the state in which a multifunction peripheral 10 is placed to be usable (the state depicted in FIG. 1). A front-rear direction 8 is defined as an opening 13 of the multifunction peripheral 10 is provided on the near side (the front side). A left-right direction 9 is defined as the multifunction peripheral 10 is seen from the near side (the front side).

<Overall Configuration of Multifunction Peripheral 10>

As depicted in FIG. 1, the multifunction peripheral 10 (an exemplary ink-jet recording apparatus) has a substantially rectangular parallelepiped shape. The multifunction peripheral 10 includes, at a lower portion of the multifunction peripheral 10, a printer unit 11 that records an image onto a sheet 12 (see FIG. 2) or the like. The multifunction peripheral 10 includes, at an upper portion of the multifunction peripheral 10, a scanner unit 14 that reads an image of a document. The multifunction peripheral 10 has a scanning function, a facsimile function, and the like, in addition to a print function. In the present description, detailed explanations for a configuration of the scanner unit 14, the scan function, and the facsimile function will be omitted.

<Feed Tray 20 and Discharge Tray 21>

Figure 2:
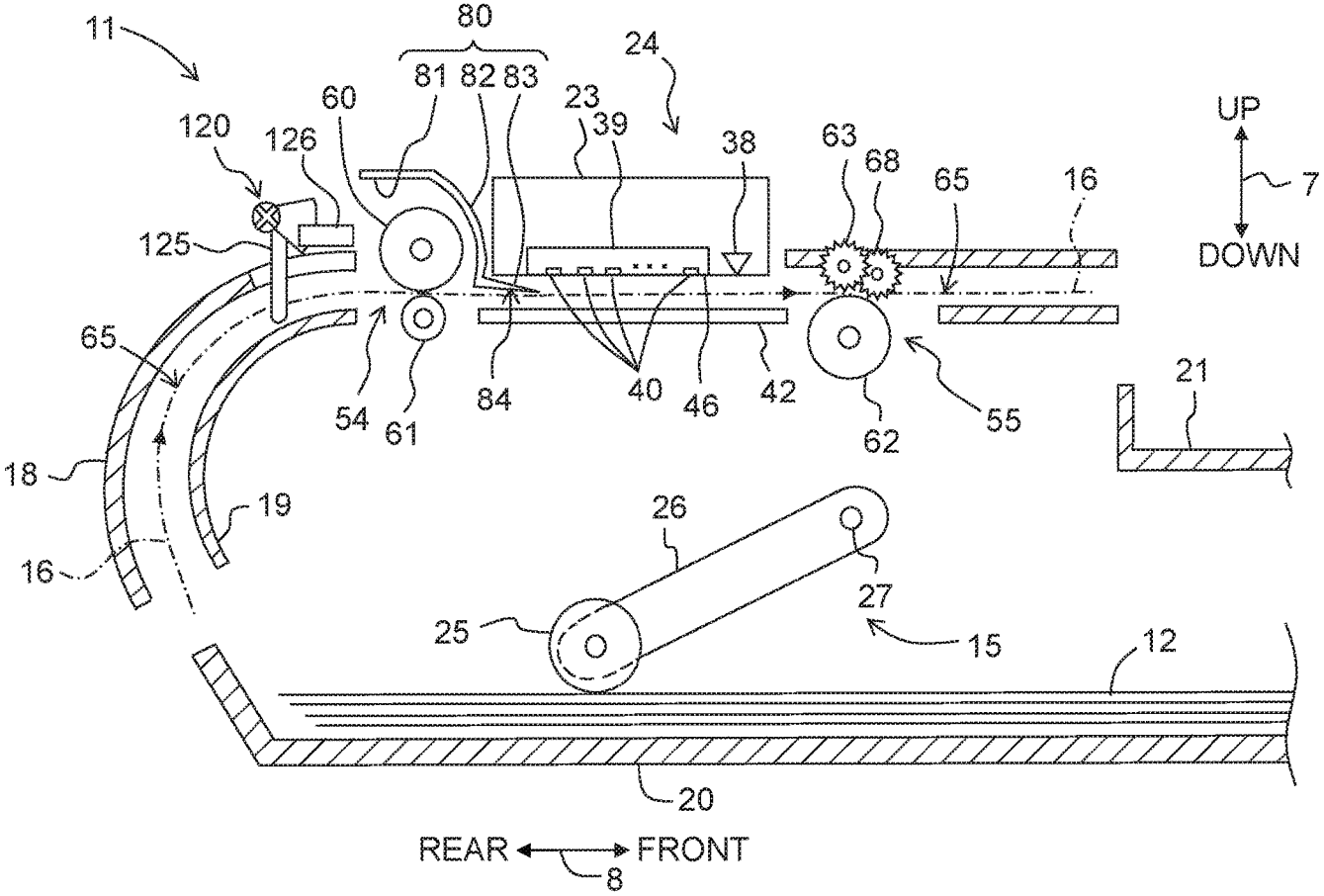
FIG. 2 is a vertical cross-sectional view schematically depicting an internal structure of a printer unit.

As depicted in FIG. 1, a feed tray 20 is disposed at a lowermost portion of the printer unit 11. The feed tray 20 may be inserted into or removed from a casing of the multifunction peripheral 10 in the front-rear direction 8 through the opening 13 formed in the front surface of the printer unit 11. As depicted in FIG. 2, the feed tray 20 supports sheets 12 stacked therein. A discharge tray 21 is arranged immediately above the feed tray 20. The discharge tray 21 supports the sheet 12 discharged from a conveyance route 65.

<Feed Unit 15>

As depicted in FIG. 2, a feed unit 15 is provided above the feed tray 20 installed to the printer unit 11. The feed unit 15 includes a feed roller 25, a feed arm 26, and a shaft 27. The feed roller 25 is provided to be rotatable on the front-end side of the feed arm 26. The feed roller 25 rotates when driving force is applied thereto from a feed motor 101 (see FIG. 9). The feed arm 26 is pivotably supported by the shaft 27 that is supported by a frame of the printer unit 11. The feed arm 26 is urged toward the feed tray 20 by elastic force of a spring or the like, or by the self-weight of the feed arm 26. The feed roller 25 rotates in contact with the uppermost sheet 12 supported by the feed tray 20, thus feeding the uppermost sheet 12 to the conveyance route 65.

<Conveyance Route 65>

As depicted in FIG. 2, the conveyance route 65 is a route or path which extends from a rear-end portion of the feed tray 20 toward the rear side of the printer unit 11, makes a U-turn frontwardly while extending from the lower side to the upper side at the rear side of the printer unit 11, and reaches the discharge tray 21 via the recording unit 24. A part of the conveyance route 65 is a space defined in the interior of the printer unit 11 by use of an outer guide member 18 and an inner guide member 19 arranged to face with each other with a predetermined interval (gap) intervened therebetween. The conveyance route 65 passes a pinching position by use of a conveyance roller unit 54, a position between the platen 42 and the recording head 39, and a pinching position by use of a discharge roller unit 55 to reach the discharge tray 21. In FIG. 2, a conveyance direction 16 of the sheet 12 in the conveyance route 65 is indicated by an arrow of a dot-dash chain line. In the conveyance route 65, a resist sensor 120 extending from the outer guide member 18 to the conveyance route 65 is provided upstream of the conveyance roller unit 54 in the conveyance direction 16. The resist sensor 120 includes a detecting element 125 and an optical sensor 126. The detecting element 125 is rotatable to advance to or retract from the conveyance route 65. The optical sensor 126 is configured to detect a rotating posture of the detecting element 125. When the sheet 12 conveyed through the conveyance route 65 makes contact with the detecting element 125 of the resist sensor 120, the detecting element 125 protruding into the conveyance route 65 rotates to retract from the conveyance route 65.

<Conveyance Roller Unit 54 and Discharge Roller Unit 55>

As depicted in FIG. 2, the conveyance roller unit 54 (an exemplary conveyor) is arranged in the conveyance route 65 at a position downstream of the feed unit 15 and upstream of the recording unit 24, in the conveyance direction 16. The conveyance roller unit 54 includes a conveyance roller 60 and a pinch roller 61. The conveyance roller 60 is driven by a conveyance motor 102. The pinch roller 61 rotates following the rotation of the conveyance roller 60. The sheet 12 is conveyed in the conveyance direction 16 in a state of being pinched between the conveyance roller 60 and the pinch roller 61.

Figure 5:
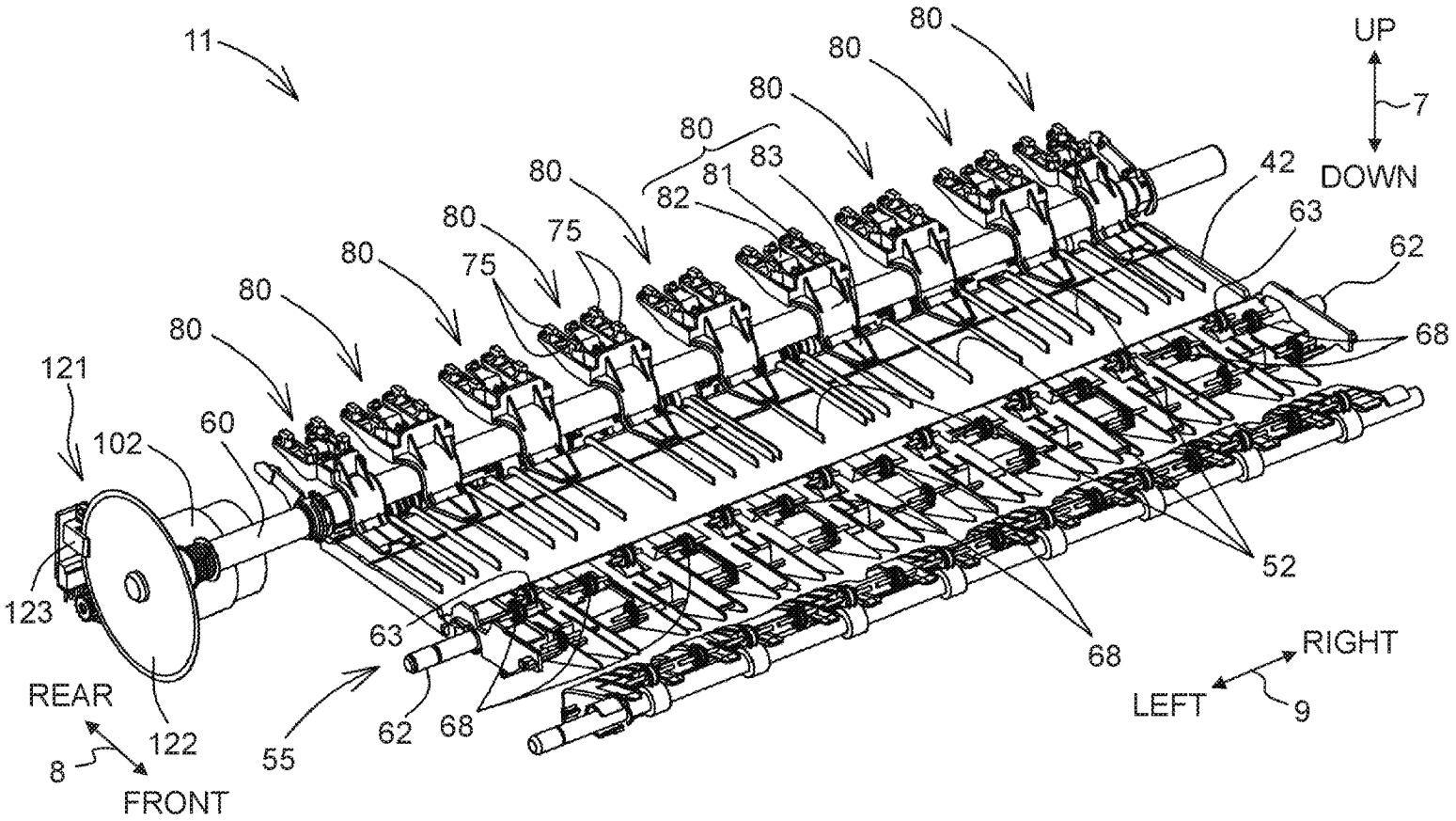
FIG. 5 is a perspective view of contact members and a platen.

As depicted in FIG. 5, the conveyance roller 60 is provided with a rotary encoder 121. The rotary encoder 121 includes a disk-shaped encoder disk 122 and an optical sensor 123. The encoder disk 122 and the conveyance roller 60 are fixed coaxially to the same shaft, and the encoder disk 122 rotates together with the conveyance roller 60. In the encoder disk 122, transmissive parts and non-transmissive parts extending radially are alternately arranged at regular pitches in a circumferential direction. The optical sensor 123 detects a pattern of the encoder disk 122 rotating together with the conveyance roller 60 and outputs a pulse signal to the controller 130. The controller 130 calculates the rotating direction and speed of the conveyance roller 60 based on the pulse signal to control the rotating amount of the conveyance roller 60, and the like.

The discharge roller unit 55 (an exemplary conveyor) is arranged in the conveyance route 65 at a position downstream of the recording unit 24 in the conveyance direction 16. The discharge roller section 55 includes a discharge roller 62 and a spur 63. The discharge roller 62 is driven by the conveyance motor 102. The spur 63 rotates following the rotation of the discharge roller 62. The sheet 12 is conveyed in the conveyance direction 16 in a state of being pinched between the discharge roller 62 and the spur 63. The discharge roller 62 rotates in synchronization with the conveyance roller 60.

<Platen 42>

Figure 3:
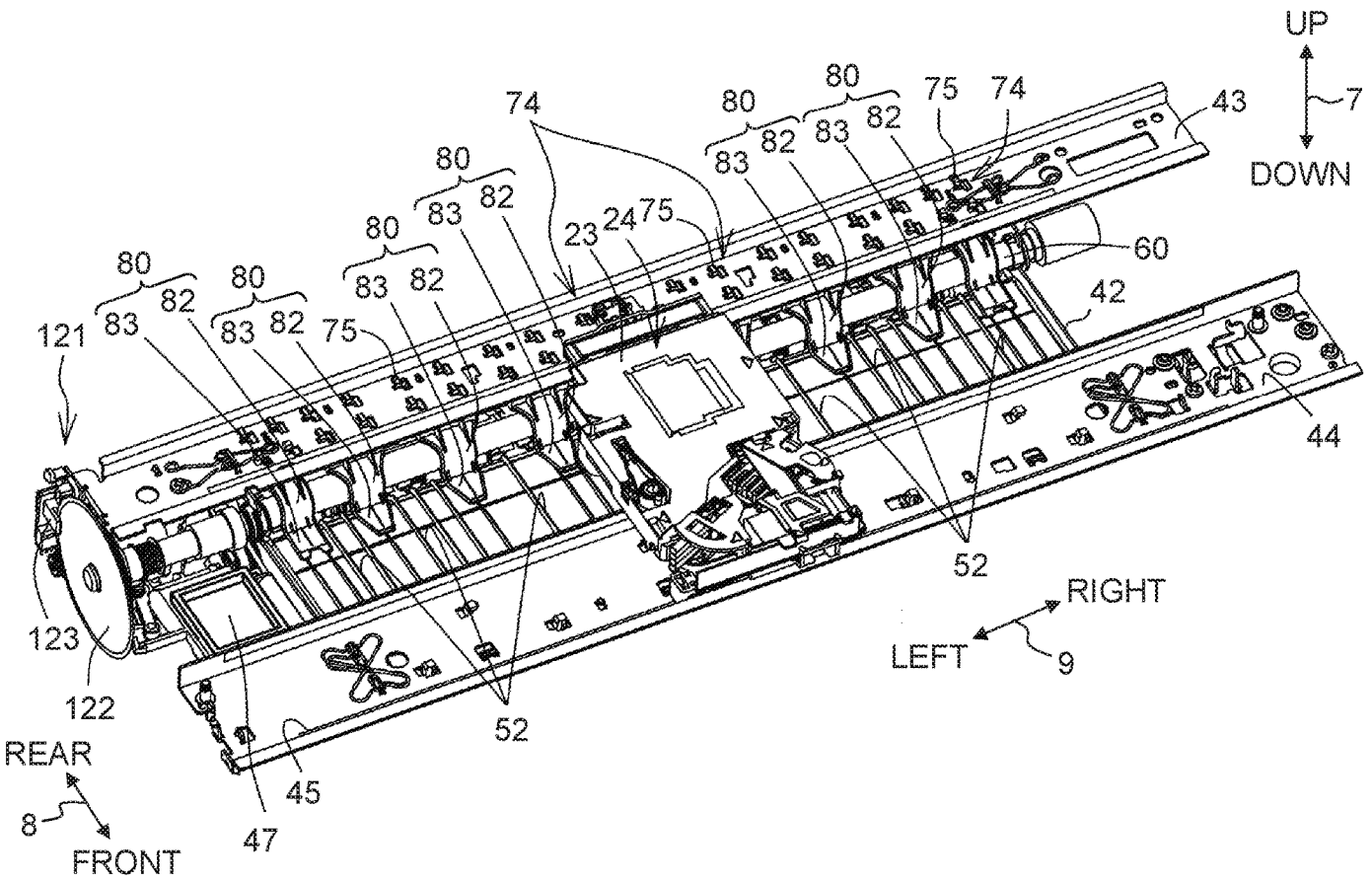
FIG. 3 is a perspective view of a recording unit supported by guide rails.
Figure 7:
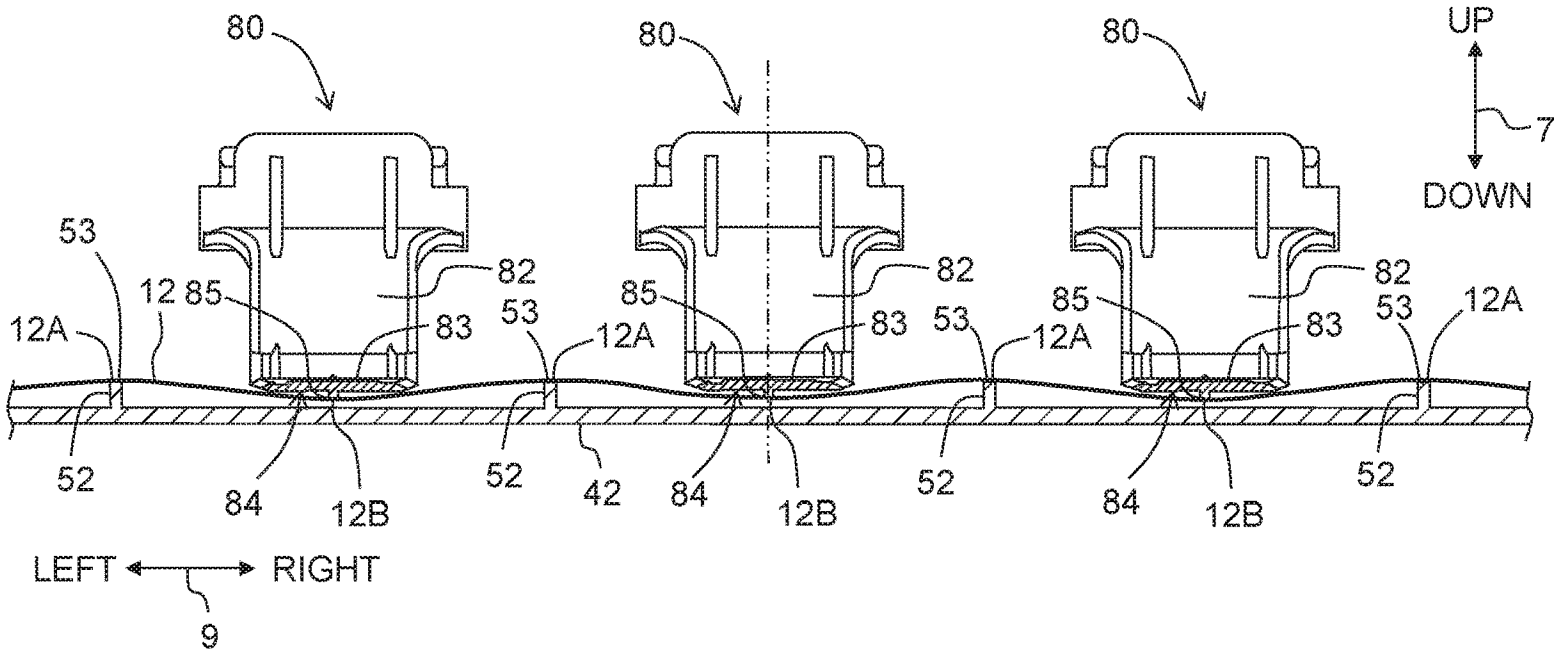
FIG. 7 is a cross-sectional view depicting a positional relation between support ribs of the platen and contact ribs of the contact members.

As depicted in FIGS. 2, 3 and 7, the platen 42 is arranged at a position below the conveyance route 65 and between the conveyance roller unit 54 and the discharge roller unit 55 in the conveyance direction 16. The platen 42 is arranged to face the recording unit 24 and supports the sheet 12 conveyed through the conveyance route 65, from therebelow. An upper surface of the platen 42 (an exemplary sheet facing area) includes support ribs 52 protruding upward and extending in the front-rear direction 8. The support ribs 52 are arranged at predefined intervals in the left-right direction 9. The sheet 12 conveyed through the conveyance route 65 is supported by the platen 42, strictly, by protruding ends 53 of the support ribs 52 formed on the upper surface of the platen 42.

<Waste Ink Tray 47>

As depicted in FIG. 3, a waste ink tray 47 (an exemplary ink receiving part) is provided on one side of the platen 42 (the left side in FIG. 3) in the left-right direction 9. The waste ink tray 47 is disposed outside a sheet supporting area of the platen 42, namely, outside an ink jetting area.

The waste ink tray 47 is configured to receive ink droplets that are jetted from the recording head 39 at the time of flushing. The flushing is performed to recover ink jetting performance and to keep the ink condition in each nozzle 40 good. When the flushing is performed, the recording head 39 is moved to a position above the waste ink tray 47, where ink droplets are jetted from the nozzles 40 of the recording head 39 to the waste ink tray 47.

<Recording Unit 24>

As depicted in FIGS. 2 and 3, the recording unit 24 is arranged at a position above the conveyance route 65 and between the conveyance roller unit 54 and the discharge roller unit 55 in the conveyance direction 16. The recording unit 24 is arranged to face the platen 42. The recording unit 24 includes a carriage 23 that is movable in the left-right direction 9 (an exemplary main scanning direction) along the guide rails 43 and 44 and the recording head 39 mounted on the carriage 23. The guide rails 43 and 44 extending in the left-right direction 9 are arranged to be separated from each other in the front-rear direction 8. The guide rails 43 and 44 are fitted to a frame (not depicted in the drawings) supporting the conveyance roller 60 and the platen 42. Applying driving force from a carriage motor 103 (see FIG. 9) to the carriage 23 moves the carriage 23 in the left-right direction 9.

Figure 4:
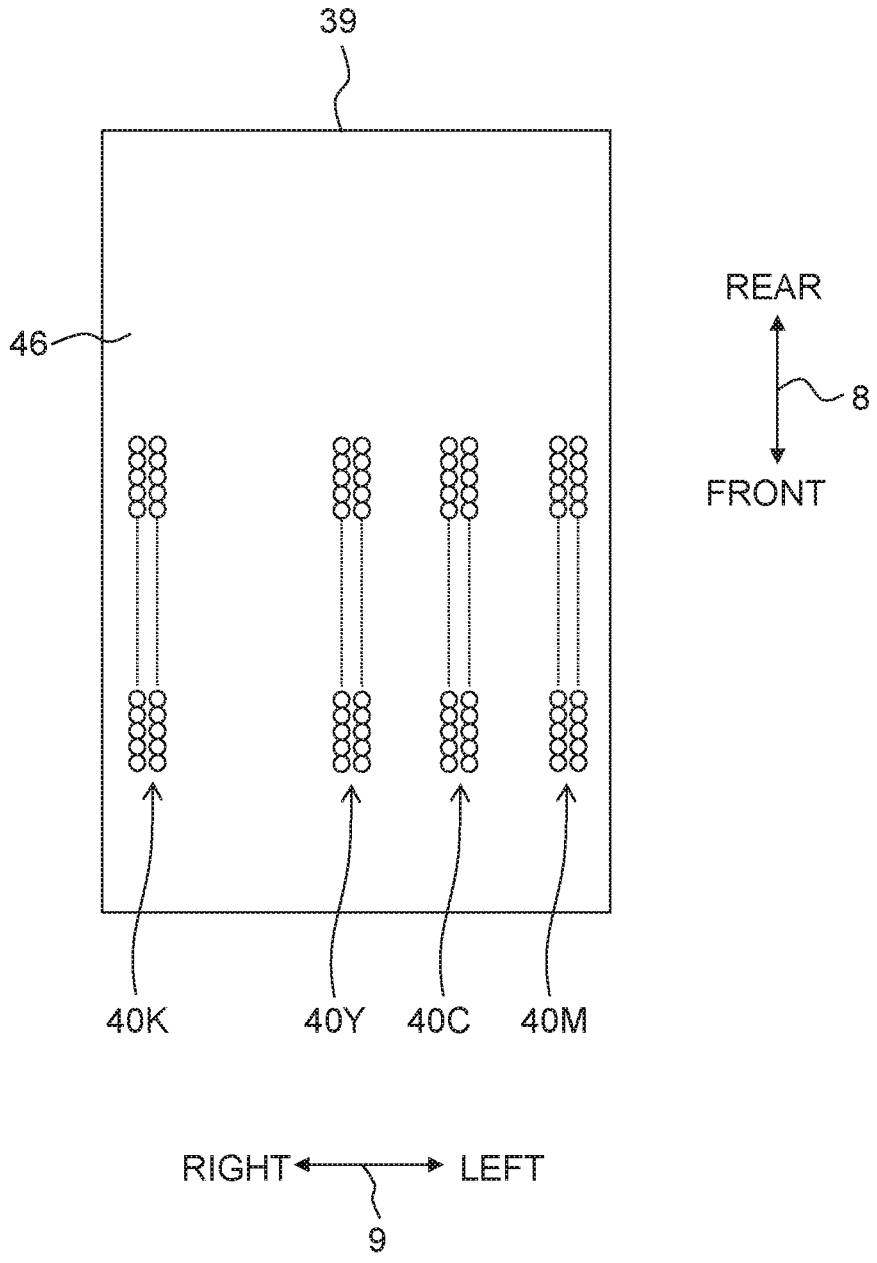
FIG. 4 is a bottom view of a nozzle surface of a recording head.

As depicted in FIG. 4, the recording head 39 includes a nozzle surface 46 (see FIG. 2) facing the platen 42. The nozzles 40 are formed on the nozzle surface 46. The carriage 23 supports the recording head 39 such that the nozzle surface 46 faces the platen 42. The recording head 39 includes nozzle rows 40K, 40Y, 40C, and 40M corresponding to four colors of inks including black, yellow, cyan, and magenta inks. Each of the nozzle rows 40K, 40Y, 40C, and 40M is configured by nozzles 40 arranged in the front-rear direction 8 to form two rows. The nozzle rows 40K, 40Y, 40C, and 40M are arranged to be separated from each other in the left-right direction 9. The nozzles 40 configuring the nozzle row 40K are exemplary first nozzles. The nozzles 40 configuring the nozzle row 40Y are exemplary second nozzles.

Figure 9:
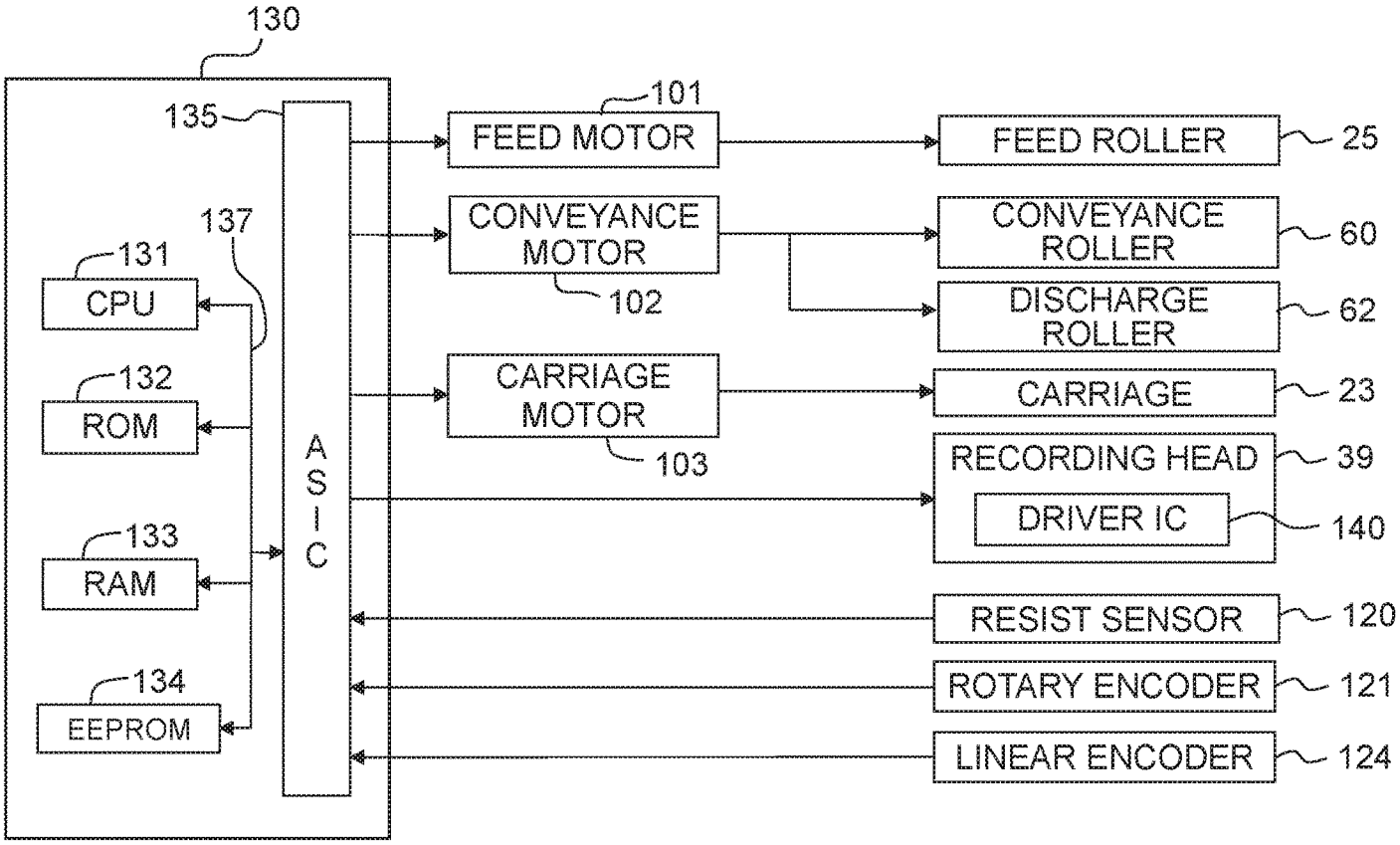
FIG. 9 is a block diagram of a controller of the multifunctional peripheral.

Although not illustrated in FIGS. 2 and 3, the guide rail 44 includes a linear encoder 124 (see FIG. 9). The linear encoder 124 includes an unillustrated encoder strip provided in the guide rail 44 and an encoder sensor mounted on the carriage 23. The encoder strip is formed in a belt shape, and transmissive parts and non-transmissive parts are alternately arranged at regular pitches in a longitudinal direction of the guide rail 44. The carriage 23 is provided with the encoder sensor that is a transmission-type optical sensor. The encoder sensor detects a pattern of the encoder strip during reciprocating movement of the carriage 23 and outputs a pulse signal to the controller 130. The controller 130 calculates the moving direction and speed of the carriage 23 based on the pulse signal to perform constant-speed control and acceleration/deceleration control of the carriage 23 during its reciprocating movement.

The recording head 39 jets the inks of four colors supplied from the corresponding ink cartridges (not depicted in the drawings), from nozzles 40 during its movement together with the carriage 23 in the left-right direction 9.

Figure 6:
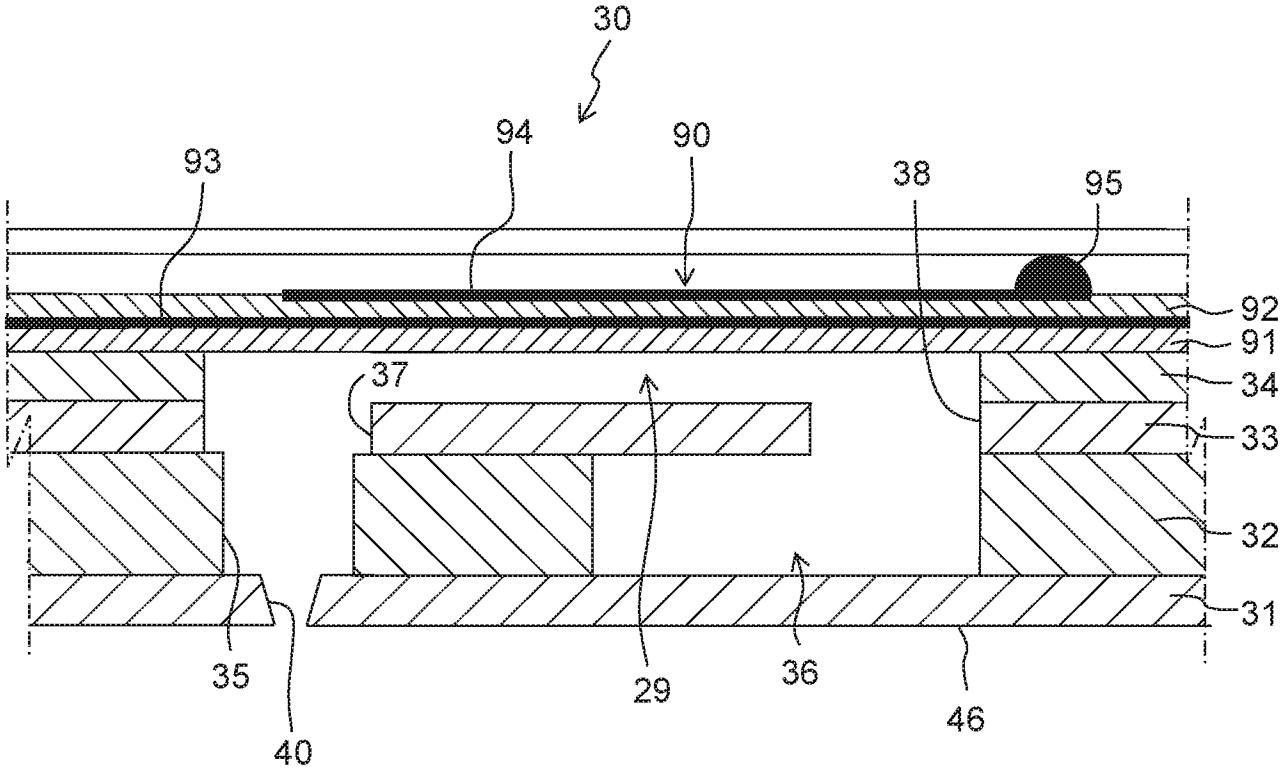
FIG. 6 is a cross-sectional view schematically depicting a configuration of the recording head that includes a channel unit and a piezoelectric actuator.

As depicted in FIG. 6, the recording head 39 includes a channel unit 30 and a piezoelectric actuator 90. The channel unit 30 is configured by stacked four plates 31 to 34, such as metal plates. The plate 31 has the nozzle surface 46 in which the nozzles 40 are defined by through holes. The plate 32 includes through holes 35 at positions overlapping with the nozzles 40. The plate 32 includes at least four manifold channels 36 at positions not overlapping with the nozzles 40.

The plate 33 includes through holes 37 at positions overlapping with the nozzles 40 and through holes 38 at positions overlapping with the manifold channels 36. The plate 34 includes pressure chambers 29. Each of the pressure chambers 29 overlaps with the corresponding one of thorough holes 37 and the corresponding one of thorough holes 38. Namely, one nozzle 40 communicates with one through hole 35, one through hole 37, one pressure chamber 29, and one through hole 38. Each of the manifold channels 36 communicates with the thorough holes 38. Although not illustrated in FIG. 6, each of the inks of four colors is supplied from the corresponding one of the ink cartridges to the corresponding one of the manifold channels 36. Ink channels are formed to extend from the manifold channels 36 to the nozzles 40 via the pressure chambers 29.

The piezoelectric actuator 90 includes a vibration plate 91, a piezoelectric layer 92, a common electrode 93, and individual electrodes 94. The vibration plate 91 is made from, for example, a piezoelectric material. The vibration plate 91 is disposed above the channel unit 30 to cover pressure chambers 29. The piezoelectric layer 92, which is made from, for example, a piezoelectric material, is disposed on an upper surface of the vibration plate 31 to extend across the pressure chambers 29.

The common electrode 93 is disposed between the vibration plate 91 and the piezoelectric layer 92 to extend along them. The common electrode 93 is kept at a ground potential. The individual electrodes 94, which are provided corresponding to the pressure chambers 29 individually, are disposed on an upper surface of the piezoelectric layer 92. Any of the ground potential (exemplary second voltage) and a predefined driving potential (exemplary first voltage) is selectively applied to each individual electrode 94. A part, of the piezoelectric layer 92, sandwiched between each individual electrode 94 and the common electrode 93 is polarized in its thickness direction.

Each individual electrode 94 includes a bump terminal 95 at a portion not facing the pressure chamber 29. Each individual electrode 94 is electrically connected to a boosting buffer 147 of a driver IC 140 (an exemplary head control substrate) via the bump terminal 95. In the following description, a part of the piezoelectric actuator 90 corresponding to each pressure chamber 29 (and each nozzle 40 communicating with the corresponding piezoelectric chamber 29) will be referred to as a driving element. Each driving element applies pressure to the ink in the corresponding pressure chamber 29 so as to jet the ink from the nozzle 40. For example, applying the driving potential to the individual electrode 94 of a predefined driving element causes the predefined driving element to swell toward the piezoelectric chamber 29. This keeps the pressure chamber 29 corresponding to the predefined driving element a first volume. Then, applying the ground potential to the individual electrode 94 of the predefined driving element eliminates the swelling of the predefined driving element toward the pressure chamber 29. This causes the pressure chamber 29 corresponding to the predefined driving element to swell so as to have a second volume larger than the first volume. The driving elements corresponding to the nozzles 40 forming the nozzle row 40K are exemplary first driving elements. The driving elements corresponding to the nozzles 40 forming the nozzle row 40Y are exemplary second driving elements.

<Contact Member 80>

Figure 8:
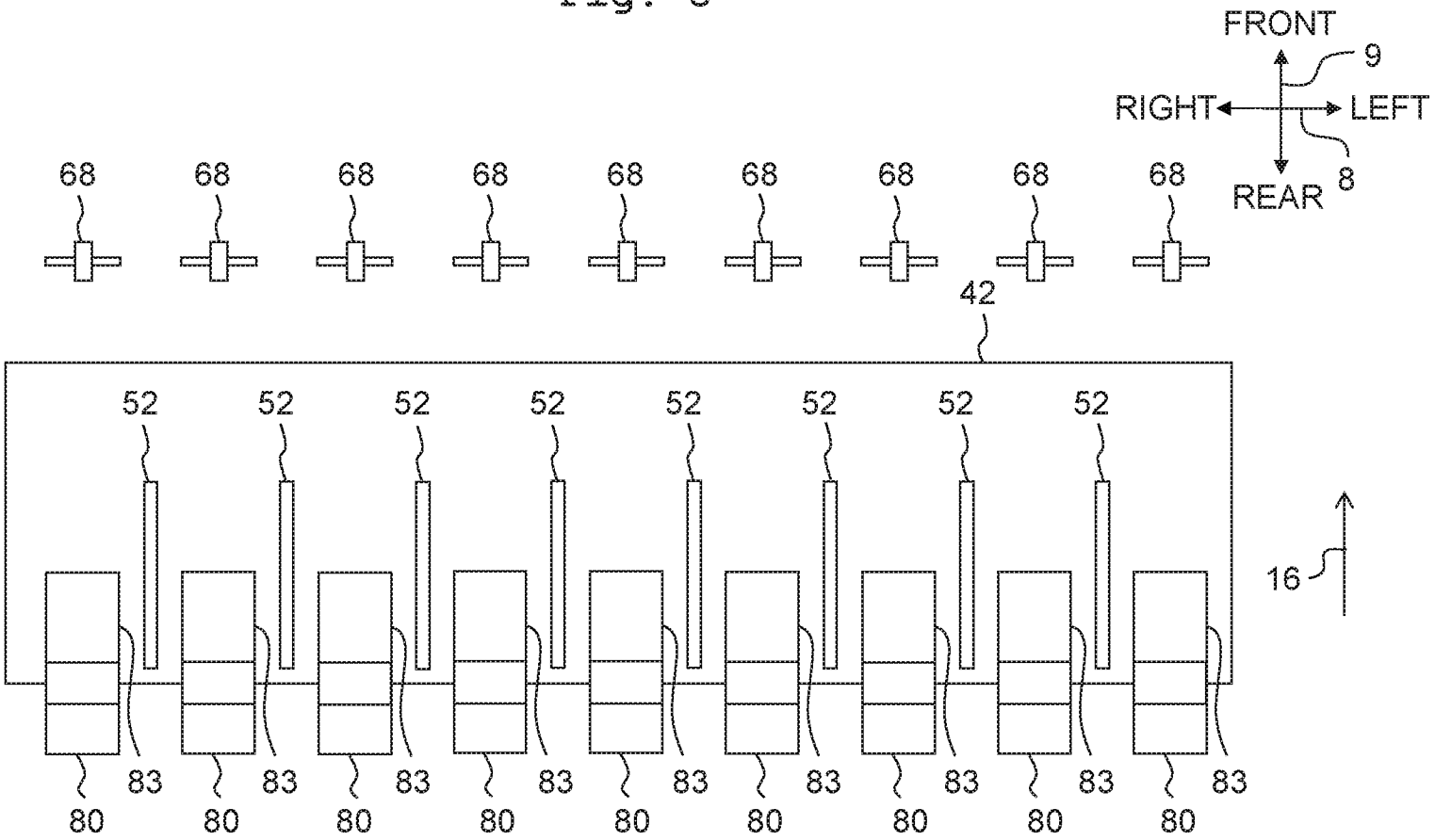
FIG. 8 schematically depicts a positional relation between an arm of a resist sensor and contact members and corrugated spurs.

As depicted in FIGS. 2, 3, and 5, contact members 80 are provided in the conveyance route 65 at positions upstream of the recording head 39 in the conveyance direction 16. The contact members 80 are provided to be separated from each other in the left-right direction 9. As depicted in FIGS. 7 and 8, the contact members 80 are arranged at different positions in the left-right direction 9 to correspond to a wave shape to be applied to the sheet 12. Each contact member 80 is configured by a fixing part 81, a curved part 82, and a contact part 83.

The fixing part 81 has a substantially flat plate shape. Each contact member 80 is fixed to the guide rail 43 by use of the fixing part 81. An upper surface of the fixing part 81 includes protruding locking parts 75. Each contact member 80 is fixed to a lower surface of the guide rail 43 by fitting the locking parts 75 into circumferences of openings 74 of the guide rail 43.

The curved part 82 extends from the fixing part 81 and curves frontward (downstream in the conveyance direction 16) and downward. A front end of the curved part 82 includes the contact part 83 that protrudes substantially in the conveyance direction 16.

The contact part 83, which has a substantially flat plate shape, is provided at a position facing the platen 42 in the up-down direction 7. The contact part 83 is positioned between the recording head 39 and the platen 42 in a direction (the up-down direction 7 in this embodiment) orthogonal to the conveyance direction 16 and the left-right direction 9. A lower surface 84 of the contact part 83 includes a contact rib 85 protruding downward. A lower end of the contact rib 85 makes contact with an upper surface of the sheet 12 supported by the platen 42. This allows the contact parts 83 to press concave portions 12B (see FIG. 7) of the sheet 12 downward (toward the platen 42). The front ends (downstream ends in the conveyance direction 16) of the contact ribs 85 are positioned downstream of the conveyance roller unit 54 and upstream of the nozzles 40, in the conveyance direction 16.

As depicted in FIG. 7, each contact part 83 is positioned between the adjacent support ribs 52 formed on the upper surface of the platen 42 to be separated from each other in the left-right direction 9. In other words, each support rib 52 protrudes toward the recording head 39 at a position between the contact members 80 adjacent to each other in the left-right direction 9. Namely, the contact ribs 85 and the support ribs 52 are alternately arranged in the left-right direction 9. The protruding end 53 of each support rib 52 is positioned above the lower end of each contact rib 85 (on the side of the recording head 39). Thus, the protruding end 53 of each support rib 52 makes contact with a convex portion 12A of the sheet 12 at a position closer to the recording head 39 than a position at which the contact rib 85 makes contact with the sheet 12.

The contact members 80 and the support ribs 52 of the platen 42 make the sheet have a wave shape when seen from the upstream or downstream side in the conveyance direction 16.

<Corrugated Spurs 68>

As depicted in FIGS. 2 and 8, corrugated spurs 68 are provided downstream of the discharge roller unit 55 in the conveyance direction 16. The corrugated spurs 68 are provided to be separated from each other in the left-right direction 9. The corrugated spurs 68 are arranged below the spurs 63 of the discharge roller unit 55 in the up-down direction 7. This allows the corrugated spurs 68 to make contact with the upper surface of the sheet 12.

As depicted in FIG. 8, each corrugated spur 68 is arranged at substantially the same position in the left-right direction 9 as the contact part 83 of each contact member 80. In other words, the contact parts 83 and the corrugated spurs 68 are arranged in a row in the front-rear direction 8. This allows the contact part 83 and the corrugated spur 68 to make contact with the substantially same position in the sheet 12.

<Wave Shape of Sheet 12>

As depicted in FIG. 7, the shape of the sheet 12 in the left-right direction 9 at a position facing the recording head 39 is a wave shape having the convex portions 12A and the concave portions 12B alternately arranged in the left-right direction 9. Each convex portion 12A is a boundary position at which the distance between the recording head 39 and the sheet 12 changes from decrease to increase along the left-right direction 9. The convex portions 12A substantially correspond to the positions of the protruding ends 53 of the support ribs 52 of the platen 42. Each concave portion 12B is a boundary position at which the distance between the recording head 39 and the sheet 12 changes from increase to decrease along the left-right direction 9. The concave portions 12B substantially correspond to the positions of the corrugated spurs 68 and the contact ribs 85 of the contact members 80. The shape between the convex portion 12A and the concave portion 12B adjacent to each other is a curved shape that is substantially approximated by a cubic function.

In this embodiment, the nine contact members 80 are provided to be separated from each other in the left-right direction 9. Thus, the nine concave portions 12B are present in the sheet 12 in this embodiment. Further, in this embodiment, ends of the sheet 12 in the left-right direction 9 are the concave portions 12B for the purpose of preventing the ends of the sheet 12 in the left-right direction 9, which may otherwise be free ends, from making contact with the recording head 39. Namely, each convex portion 12A is positioned between the concave portions 12B adjacent to each other. Thus, the eight convex portions 12A are present in the sheet 12 in this embodiment. Further, in this embodiment, the concave portion 12B positioned at the center of the sheet 12 in the left-right direction 9 (i.e., the fifth concave portion 12B from the end of the sheet 12 in the left-right direction 9) is defined as a reference position. The concave portion 12B positioned at the center of the sheet 12 in the left-right direction 9 typically and substantially corresponds to the center of the sheet 12 in the left-right direction 9. Accordingly, the support ribs 52, contact members 80, and corrugated spurs 68 form a wave shape forming mechanism.

<Controller 130>

As depicted in FIG. 9, the controller 130 includes a CPU 131, a ROM 132, a RAM 133, an EEPROM 134, an ASIC 135, and an internal bus 137 connecting the above components with each other. The ROM 132 stores, for example, programs for the CPU 131 to control various operations. The RAM 133 is used as a storage area temporarily recording data, signals, and the like to be used when the CPU 131 executes the above programs, or a working area for data processing. The EEPROM 134 stores settings, flags, and the like which should be retained even after the power is turned off.

The ASIC 135 is connected to the conveyance motor 101, the feed motor 102, and the carriage motor 103. The ASIC 135 obtains driving signals for rotating the motors 101, 102, and 103 from the CPU 131 and outputs driving currents corresponding to the driving signals to the motors 101, 102, and 103. The respective motors are driven by the driving currents outputted from the ASIC 135. For example, the controller 130 controls driving of the feed motor 101 to rotate the feed roller 25. The controller 130 controls driving of the conveyance motor 102 to rotate the conveyance roller 60. The controller 130 controls driving of the carriage motor 103 to reciprocatingly move the carriage 23. The controller 130 controls the recoding head 39 to jet ink from each nozzle 40.

The ASIC 135 is electrically connected to the resist sensor 120, rotary encoder 121, and linear encoder 124. The controller 130 detects a position of the sheet 12 based on a detection signal outputted from the resist sensor 120 and a pulse signal outputted from the rotary encoder 121. The controller 130 detects a position of the carriage 23 based on a pulse signal obtained from the linear encoder 124.

<Driver IC 140>

Figure 10:
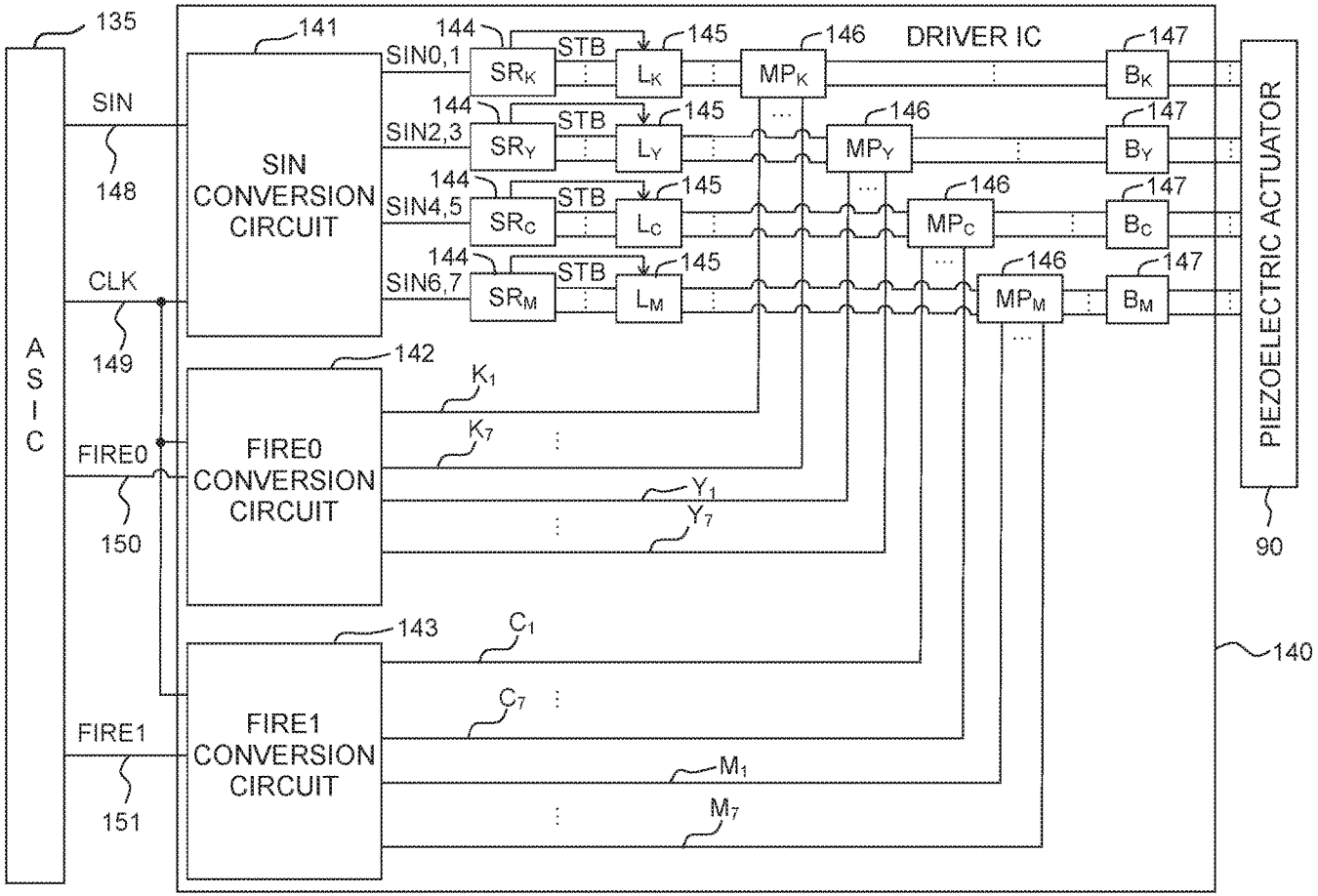
FIG. 10 is a block diagram depicting an ASIC, a driver IC, and the piezoelectric actuator.

The carriage 23 carries the driver IC 140 (an exemplary head driving circuit) together with the recording head 39. As depicted in FIG. 10, the driver IC 140 is electrically connected to the piezoelectric actuator 90 of the recording head 39. The driver IC 140 is electrically connected to the ASIC 135 of the controller 130 via a flexible flat cable. The flexible flat cable changes its posture following the reciprocating movement of the carriage 23. For example, high-frequency signals (SIN, CLK, FIRE0, FIRE1, and the like) in a Low Voltage Differential Signaling (LVDS) system are transmitted from the ASIC 135 to the driver IC 140 via the flexible flat cable. Further, the ground potential and a predefined driving potential are applied from the ASIC 135 to the driver IC 140. FIG. 10 depicts signal lines 148 to 151 that are conductive lines provided for the flexible flat cable. The signal line 148 is an exemplary second signal line. The signal line 149 is an exemplary third signal line. Each of the signal lines 150 and 151 is an exemplary first signal line.

The driver IC 140 includes a SIN conversion circuit 141 (an exemplary second conversion circuit), a FIRE0 conversion circuit 142 (an exemplary first conversion circuit), a FIRE1 conversion circuit 143, shift resistors 144 ($SR_K$, $SR_Y$, $SR_C$, $SR_M$), latch circuits 145 ($L_K$, $L_Y$, $L_C$, $L_M$), multiplexers 146 ($MP_K$, $MP_Y$, $MP_S$, $MP_M$), and boosting buffers 147 ($B_K$, $B_Y$, $B_C$, $B_M$). The shift resistors 144, latch circuits 145, and boosting buffers 147 are examples of a first output circuit and a second output circuit.

A jetting instruction signal SIN, reset signal, and clock signal CLK are inputted to the SIN conversion circuit 141. The jetting instruction signal SIN includes a control signal for the piezoelectric actuator 90 and a strobe signal STB (an exemplary output signal) for each latch circuit 145. The jetting instruction signal SIN is a serial signal generated by the ASIC 135. The SIN conversion circuit 141 generates four selection signals SIN0, 1, SIN2, 3, SIN4, 5, and SIN6, 7 from the jetting instruction signal SIN and outputs them in parallel to the respective shift resistors 144. The selection signal SIN0, 1 is a control signal for the driving elements corresponding to the nozzle row 40K. The selection signal SIN2, 3 is a control signal for the driving elements corresponding to the nozzle row 40Y. The selection signal SIN4, 5 is a control signal for the driving elements corresponding to the nozzle row 40C. The selection signal SIN6, 7 is a control signal for the driving elements corresponding to the nozzle row M.

The pattern signal FIRE0 and clock signal CLK are inputted to the FIRE0 conversion circuit 142. The pattern signal FIRE0 is a serial signal generated by the ASIC 135. The pattern signal FIRE0 includes signals indicating seven driving waveforms $Kf_1$ to $Kf_7$ for the driving elements corresponding to the nozzle row 40K and signals indicating seven driving waveforms $Yf_1$ to $Yf_7$ for the driving elements corresponding to the nozzle row 40Y. The FIRE0 conversion circuit 142 converts the serial signal into a parallel signal in synchronization with the clock signal to generate the driving waveforms $Kf_1$ to $Kf_7$ and driving waveforms $Yf_1$ to $Yf_7$. Then, the FIRE0 conversion circuit 142 outputs them in parallel to the respective multiplexers 146 (exemplary first extraction processing).

The pattern signal FIRE1 and the clock signal CLK are inputted to the FIRE1 conversion circuit 143. The pattern signal FIRE1 is a serial signal generated by the ASIC 135. The pattern signal FIRE1 includes seven driving waveforms $Cf_1$ to $Cf_7$ for the driving elements corresponding to the nozzle row 40C and seven driving waveforms $Mf_1$ to $Mf_7$ for the driving elements corresponding to the nozzle row 40M. The FIRE1 conversion circuit 142 converts the serial signal into a parallel signal in synchronization with the clock signal CLK to generate driving waveforms $Cf_1$ to $Cf_7$ and driving waveforms $Mf_1$ to $Mf_7$. Then, the FIRE1 conversion circuit 142 outputs them in parallel to the respective multiplexers 146.

The four selection signals SIN0, 1, SIN2, 3, SIN4, 5, and SIN6, 7 and the strobe signals STB are inputted from the SIN conversion circuit 141 to the respective shift resistors 144. The clock signal CLK is inputted to the respective shift resistors 144. Each of the shift resistors 144 converts the inputted selection signal (any one of the SIN0, 1, SIN2, 3, SIN4, 5, and SIN6, 7) into signals corresponding to the respective nozzles 40 in synchronization with the clock signal CLK, and then outputs those signals in parallel to the corresponding one of the latch circuits 145. Each of the latch circuits 145 outputs the signals inputted from the corresponding one of the shift resistors 144, in parallel to the corresponding one of the multiplexers 146, as control signals corresponding to the respective nozzles 40, at a timing at which the strobe signal STB (an exemplary first output signal, an exemplary second output signal) is inputted.

Each of the multiplexers 146 selects the driving waveform for each nozzle 40 (any one of the driving waveforms $Kf_1$ to $Kf_7$, $Yf_1$ to $Yf_7$, $Cf_1$ to $Cf_7$, and $Mf_1$ to $Mf_g$ inputted from the FIRE0 conversion circuit 142 or the FIRE1 conversion circuit 143) in response to the control signals inputted from the corresponding one of the latch circuits 145. Then, each of the multiplexers 146 inputs the selected driving waveform to the corresponding one of the boosting buffers 147, as the driving waveform for the corresponding driving element. Each of the boosting buffers 147 boosts the driving waveform to the driving potential to generate the driving signal for driving the corresponding driving element, and then outputs the driving signal to the individual electrode 94 of the corresponding driving element. This switches the potential of each individual electrode 94 between the ground potential and the driving potential, thus driving each driving element.

<Jetting Instruction Signal SIN>

Figure 11A:
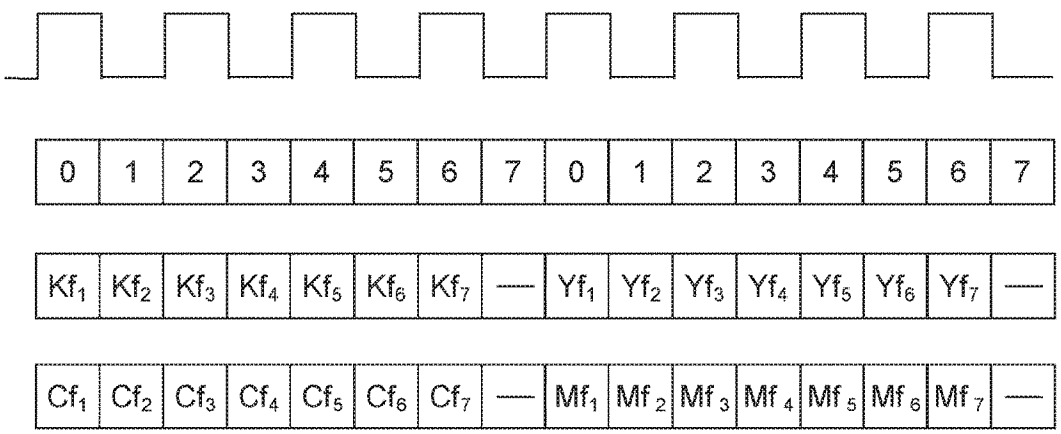
FIG. 11A schematically depicts a jetting instruction signal SIN, pattern signals FIRE0 and FIRE1, and a clock signal CLK.
Figure 11B:
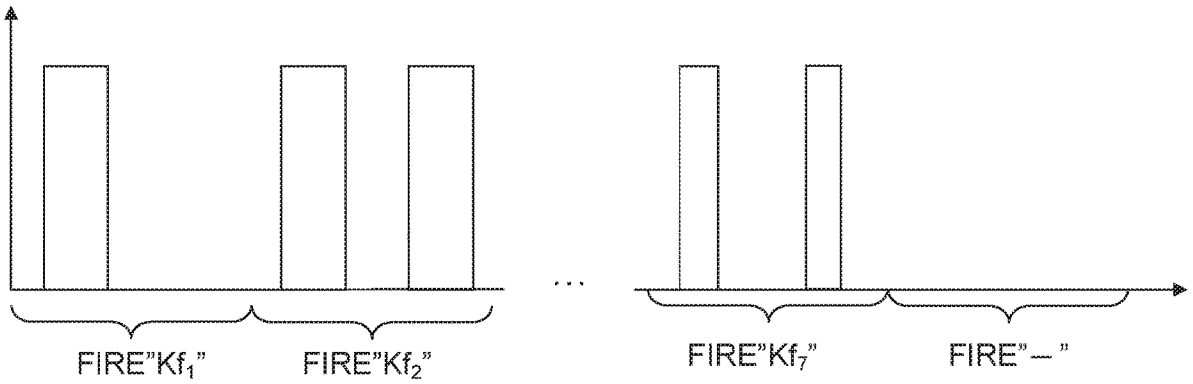
FIG. 11B depicts examples of the pattern signals.

As depicted in FIG. 11, the jetting instruction signal SIN includes a first signal area in which the selection signal SIN0, 1 corresponding to the nozzle row 40K (an exemplary first group) is set, a second signal area in which the selection signal SIN2, 3 corresponding to the nozzle row 40Y (an exemplary second group) is set, a third signal area in which the selection signal SIN4, 5 corresponding to the nozzle row 40C is set, and a fourth signal area in which the selection signal SIN6, 7 corresponding to the nozzle row 40M is set, in that order repeatedly. The selection signal corresponding to each nozzle 40 has a signal length that is 1/N (N is a natural number) of each signal area. In this embodiment, the selection signal corresponding to each nozzle 40 has a signal length of three bits corresponding to ½ (N=2) of each signal area.

The jetting instruction signal SIN includes the strobe signals STB corresponding to the nozzle rows 40K, 40Y, 40C, and 40M respectively. Each of the strobe signals STB has a signal length that is M times each signal area. The strobe signals STB are set to be distributed in signal areas. In this embodiment, each of the strobe signals STB has a signal length of 13-bits that is 13/6 times (M=13/6) of each signal area.

As indicated in FIG. 12, the jetting instruction signal SIN includes a voltage instruction signal HL indicating that a standby voltage of the driving elements is set to the driving potential or ground potential. In this embodiment, the voltage instruction signal HL is a 1-bit signal. For example, in FIG. 12, the voltage instruction signal HL is included in a row "H" of a column "SIN0". The voltage instruction signal HL indicates that the standby voltage is set to the driving potential when the voltage instruction signal HL is in a state of High (HL=1, an exemplary third value). The voltage instruction signal HL indicates that the standby potential is set to the ground potential when the voltage instruction signal HL is in a state of Low (HL=0, an exemplary fourth value).

In the ASIC 135, the jetting instruction signal SIN is generated as a signal including the selection signals SIN0 to 7, the strobe signals STB, and the voltage instruction signal HL, and the jetting instruction signal SIN is transmitted serially to the SIN conversion circuit 141 through the signal line 148. When the flying time of ink jetted from the nozzle row 40K is longer than the flying time of ink jetted from the nozzle row 40Y in recording processing, as indicated in FIG. 12, the ASIC 135 generates the jetting instruction signal SIN so that the strobe signal STB for the selection signal SIN0, 1 is outputted earlier than the strobe signal STB for the selection signal SIN2, 3. As indicated in FIG. 12, the jetting instruction signal SIN may include another control signal RSV that is transmitted to the driver IC 140. As indicated in FIG. 12, each of the shift resistors 144 extracts the selection signals SIN0 to SIN7, the strobe signals STB, and the voltage instruction signal HL in synchronization with the clock signal CLK. This processing is exemplary second extraction processing. In that processing, the selection signal (any of the SIN0 to SIN7) corresponding to each nozzle 40 (each driving element) is extracted. Further, 13-consecutive-bit High signals are extracted as one strobe signal STB.

<Pattern Signal FIRE0>

As depicted in FIG. 11, the pattern signal FIRE0 is a signal configured by signals that indicate the seven driving waveforms $Kf_1$ to $Kf_7$ for the driving elements corresponding to the nozzle row 40K and signals that indicate the seven driving waveforms $Yf_1$ to $Yf_7$ for the driving elements corresponding to the nozzle row 40Y, wherein the signals indicating the waveforms $Kf_1$ to $Kf_7$ and the signals indicating the waveforms $Yf_1$ to $Yf_7$ are arranged alternatingly and serially. Each of the driving waveforms $Kf_1$ to $Kf_7$ and $Yf_1$ to $Yf_7$ is, for example, a pulse signal indicating a timing and time at which the ground potential is applied to the individual electrode 94 having the standby voltage kept at the driving potential. The driving waveforms $Kf_1$ to $Kf_7$ generated by the FIRE0 conversion circuit 142 are outputted in parallel to the multiplexer 146 ($MP_K$). The multiplexer 146 ($MP_K$) selects any of the driving waveforms $Kf_1$ to $Kf_7$ for each nozzle 40 for the black ink, and inputs it to the boosting buffer 147 ($B_K$). The boosting buffer 147 ($B_K$) boosts the inputted driving waveform to the driving potential to generate the driving signal, and outputs the driving signal to the individual electrode 94 of the corresponding driving element. This processing is exemplary first application processing. The driving waveforms $Yf_1$ to $Yf_7$ generated by the FIRE0 conversion circuit 142 are outputted in parallel to the multiplexer 146 ($MP_Y$). The multiplexer 146 ($MP_Y$) selects any of the driving waveforms $Yf_1$ to $Yf_7$ for each nozzle 40 for the yellow ink, and inputs it to the boosting buffer 147 ($B_Y$). The boosting buffer 147 ($B_Y$) boosts the inputted driving waveform to the driving potential to generate the driving signal, and outputs the driving signal to the individual electrode 94 of the corresponding driving element. This processing is exemplary second application processing.

<Pattern Signal FIRE1>

As depicted in FIG. 11, the pattern signal FIRE1 is a signal configured by signals that indicate the seven driving waveforms $Cf_1$ to $Cf_7$ for the driving elements corresponding to the nozzle row 40C and signals that indicate the seven driving waveforms $Mf_1$ to $Mf_7$ for the driving elements corresponding to the nozzle row 40M, wherein the signals indicating the waveforms $Cf_1$ to $Cf_7$ and the signals indicating the waveforms $Mf_1$ to $Mf_7$ are arranged alternatingly and serially. Each of the driving waveforms $Cf_1$ to $Cf_7$ and $Mf_1$ to $Mf_7$ is, for example, a pulse signal indicating a timing and time at which the ground potential is applied to the individual electrode 94 having the standby voltage kept at the driving potential. The driving waveforms $Cf_1$ to $Cf_7$ generated by the FIRE1 conversion circuit 143 are outputted in parallel to the multiplexer 146 ($MP_C$). The multiplexer 146 ($MP_C$) selects any of the driving waveforms $Cf_1$ to $Cf_7$ for each nozzle 40 for the cyan ink, and inputs it to the boosting buffer 147 ($B_C$). The boosting buffer 147 ($B_C$) boosts the inputted driving waveform to the driving potential to generate the driving signal, and outputs the driving signal to the individual electrode 94 of the corresponding driving element. The driving waveforms $Mf_1$ to $Mf_7$ generated by the FIRE1 conversion circuit 143 are outputted in parallel to the multiplexer 146 ($MP_M$). The multiplexer 146 ($MP_M$) selects any of the driving waveforms $Mf_1$ to $Mf_7$ for each nozzle 40 for the magenta ink, and inputs it to the boosting buffer 147 ($B_M$). The boosting buffer 147 ($B_M$) boosts the inputted driving waveform to the driving potential to generate the driving signal, and outputs the driving signal to the individual electrode 94 of the corresponding driving element.

<Reset Signal>

The reset signal is a signal configured by 40×3-consecutive-bit High signals (an exemplary first value). In order to differentiate the reset signal from other signals, the reset signal is outputted consecutively from 24×3-consecutive-bit Low signals. The Low signals and reset signal are generated by the ASIC 135 as signals arranged in serial, and then transmitted to the SIN conversion circuit 141 through the signal line 148. After receiving the reset signal, the SIN conversion circuit 141 synchronizes the signal inputted through the signal line 148 with the clock signal CLK and extracts it as a new jetting instruction signal SIN. Namely, it is possible to allow the SIN conversion circuit 141 to recognize the beginning (front position) of a new jetting instruction signal SIN.

<Image Recording Processing>

Figure 13:
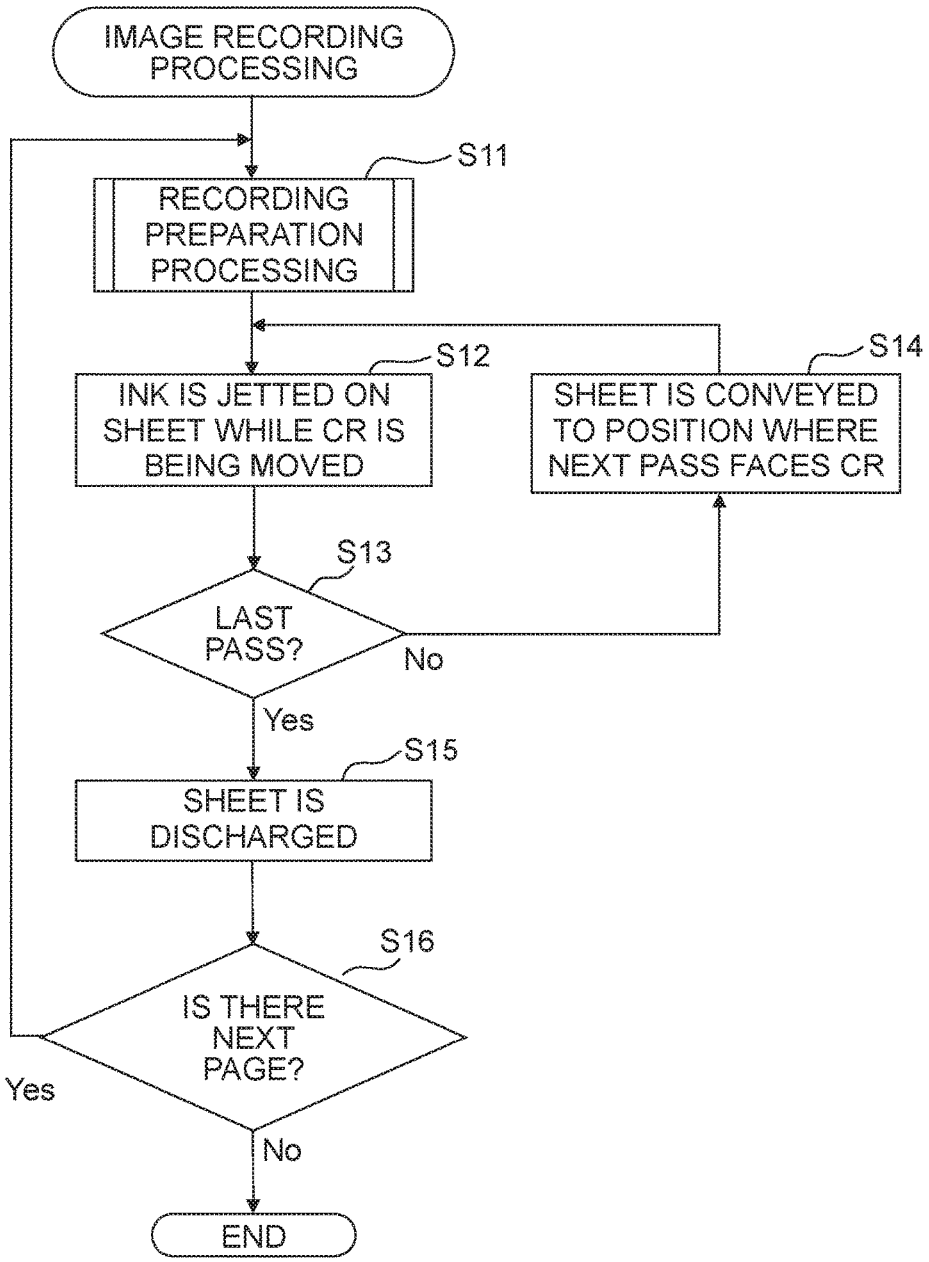
FIG. 13 is a flow chart indicating image recording processing.
Figure 14:
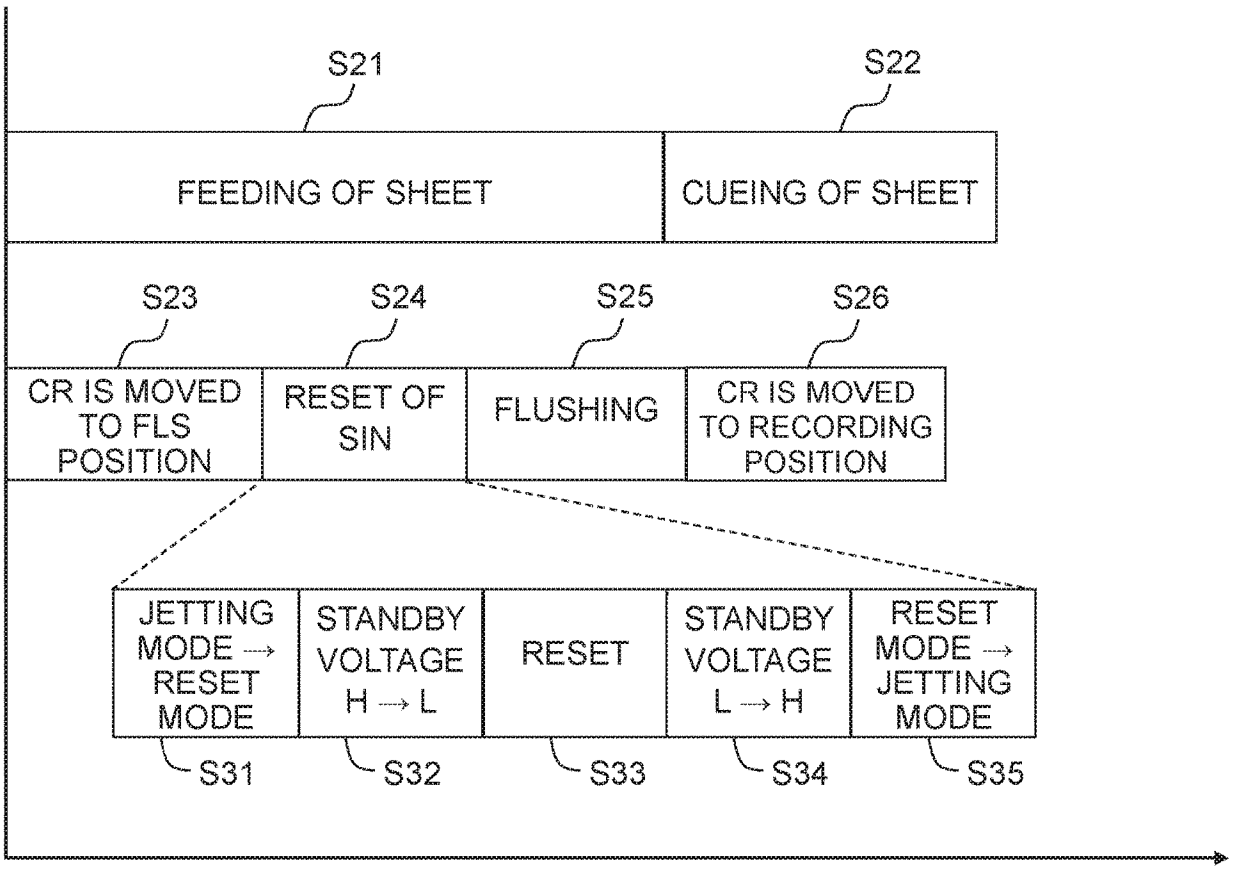
FIG. 14 is a flow chart indicating recording preparation processing.

Referring to FIGS. 13 and 14, the image recording processing of the multifunction peripheral 10 will be explained. The image recording processing is performed by the CPU 131 of the controller 130. The following processing may be performed by the CPU 131 reading each program stored in the ROM 132 or a hardware circuit mounted on the controller 130.

The controller 130 performs the image recording processing indicated in FIG. 13 upon obtaining an image recording instruction from a user. Although the way to obtain the image recording instruction is not particularly limited, the image recording instruction may be obtained through an operation panel provided in the multifunction peripheral 10 or obtained from an external device via a communication network. The controller 130 controls each roller, the carriage 23, and the recording head 39 based on the image recording instruction to perform image recording on the sheet 12. The image recording instruction may include, for example, image data to be recorded on the sheet 12, sheet type information relating to the type of the sheet 12 for which the image is to be recorded (e.g., information specifying whether the sheet 12 is regular sheet or gloss sheet), and fiber information relating to a fiber direction of the sheet 12 (i.e., information specifying whether the paper grain of the sheet 12 is perpendicular or horizontal to the long side of the sheet).

<Recording Preparation Processing (S11)>

At first, the controller 130 performs recording preparation processing (S11) in which the sheet 12 supported by the feed tray 20 is fed to a recording start position. Specifically, as depicted in FIG. 14, the controller 130 controls the feed motor 101 to rotate the feed roller 25, thereby feeding the sheet 12 on the feed tray 20 to the conveyance route 65 (S21). When the front end (downstream end in the conveyance direction 16) of the sheet 12 has arrived at the conveyance roller unit 54, the controller 130 controls the conveyance motor 102 to rotate the conveyance roller 60, thereby executing cueing of the sheet 12 (positioning of the front end of the sheet 12 at the recording start position) (S22). The recording start position is a position where an area of the sheet 12, for which an image is recorded first, faces the nozzle surface 46 of the recording head 39. The controller 130 recognizes the arrival of the sheet 12 to the conveyance roller unit 54 and the recording start position, based on the combination of the detection signal outputted from the resist sensor 120 to the controller 130 and the pulse signal from the rotary encoder 121 to the controller 130. The feeding (S21) of the sheet 12 and cueing of the sheet 12 (S22) correspond to exemplary conveyance processing.

<Reset Processing>

The controller 130 performs reset processing in parallel with the feeding of the sheet 12. First, the controller 130 performs movement processing (S23) in which the carriage motor 103 is driven to move the carriage 23 to a position where the recording head 39 faces the waste ink tray 47. The controller 130 performs the reset processing (S24) in a state where the recording head 39 faces the waste ink tray 47.

In the reset processing, the controller 130 changes a signal generation mode of the ASIC 135, from a jetting mode to a reset mode (S31). In the jetting mode, the ASIC 135 generates the above-described jetting instruction signal SIN and pattern signals FIRE0 and FIRE1.

In the reset mode, the ASIC 135 outputs the above-described reset signal to the signal line 148. As the pattern signals FIRE0 and FIRE1 generated by the ASIC 135, a pulse signal indicating only High, that is, an inversion signal indicating a pattern by which the voltage to be applied to the driving elements is continuously inverted from the standby voltage (one of the driving potential and the ground potential), or a pulse signal indicating only Low, that is, a non-inversion signal indicating a pattern by which the standby voltage is kept, is outputted to the signal lines 150 and 151. Each of the selection signals SIN0,1, SIN2, 3, SIN4, 5, and SIN6, 7 includes a High signal ("1", an exemplary first value) indicating that the driving voltage indicated by the pattern signals FIRE0 and FIRE1 is to be applied to the corresponding driving elements, or a Low signal ("0", an exemplary second value) indicating that no driving voltage is to be applied.

Figure 15:
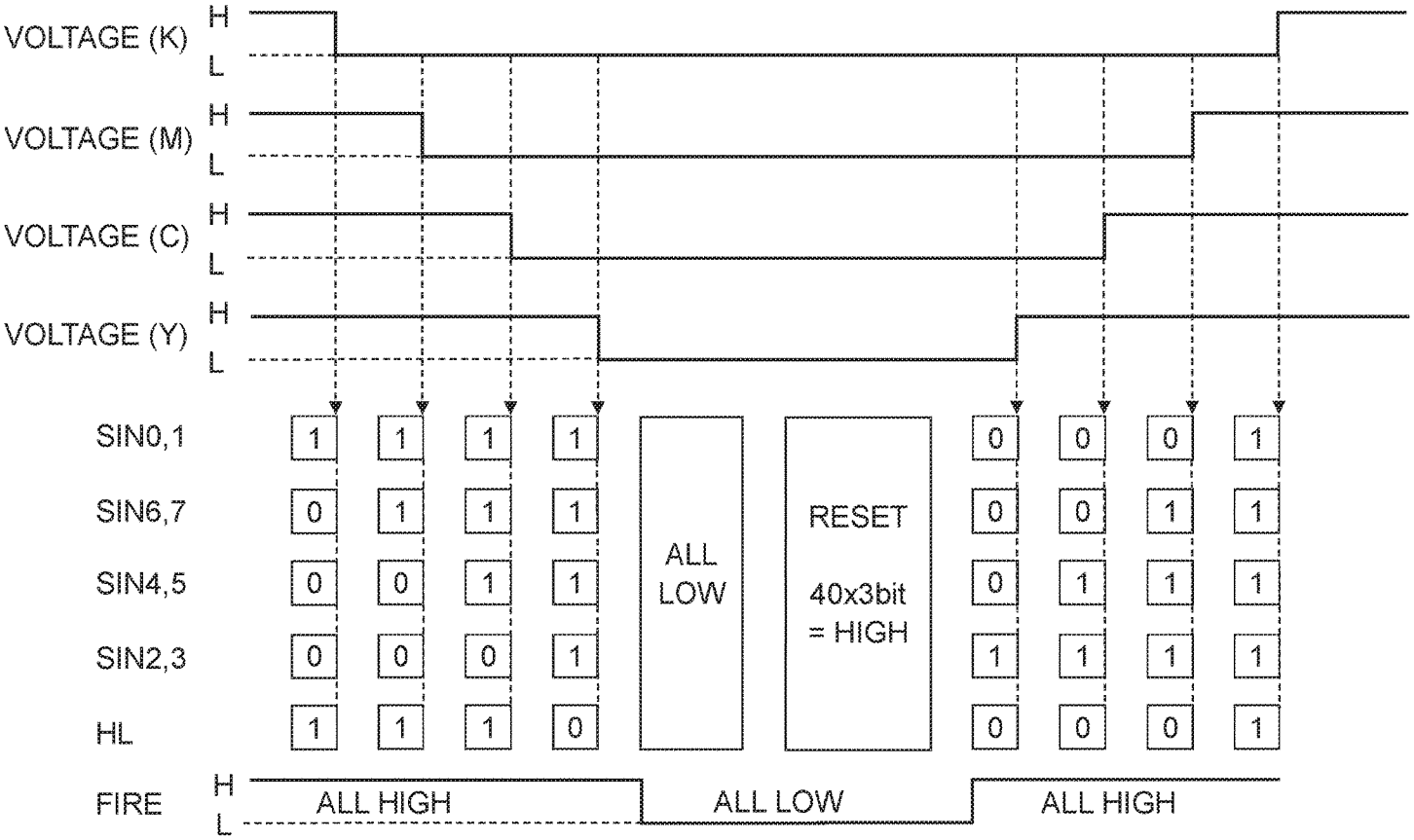
FIG. 15 schematically depicts standby voltages, SIN0 to SIN7, and a pattern signal FIRE in first switch processing, reset processing, and second switch processing.

After changed to the reset mode, as depicted in FIGS. 14 and 15, the controller 130 performs first switch processing (S32) in which the driving potential of the driving elements kept as the standby voltage is changed to the ground potential in order of the nozzle rows 40K, 40M, 40C, and 40Y. Specifically, the ASIC 135 generates, as the jetting instruction signal SIN, the selection signals SIN0,1, SIN2, 3, SIN4, 5, and SIN6, 7 including the High signal or the Low signal, the strobe signals STB, and the voltage instruction signals HL, and serially outputs them to the SIN conversion circuit 141. This output includes four strobe signals STB for the respective nozzle rows 40K, 40Y, 40C, and 40M. The ASIC 135 generates, as the pattern signals FIRE0 and FIRE1, pulse signals indicating that an inversion potential is to be applied, and outputs them to the FIRE0 conversion circuit 142 and the FIRE1 conversion circuit 143.

In output processing (exemplary first output processing) including the first strobe signal STB, the selection signal SIN0, 1 is the High signal, and each of the selection signals SIN2, 3, SIN4, 5, and SIN6, 7 is the Low signal. The voltage instruction signal HL is the High signal ("1"). The driver IC 140 receiving those signals inverts the voltage of the driving elements corresponding to the nozzle row 40K. Namely, the driver IC 140 receiving those signals makes the voltage of the driving elements corresponding to the nozzle row 40K the ground potential. The standby voltage of all the driving elements is kept at the driving potential.

In the output processing including the next strobe signal STB, the selection signals SIN0, 1 and SIN6, 7 are the High signals, and the selection signals SIN2, 3 and SIN4 are the Low signals. The voltage instruction signal HL is the High signal ("1"). The driver IC 140 receiving those signals inverts the voltage of the driving elements corresponding to the nozzle rows 40K and 40M. Namely, the driver IC 140 receiving those signals makes the voltage of the driving elements corresponding to the nozzle rows 40K and 40M the ground potential. The standby voltage of all the driving elements is kept at the driving potential.

In the output processing including the next strobe signal STB, the selection signals SIN0, 1, SIN4, 5, and SIN6, 7 are the High signals, and the selection signal SIN2, 3 is the Low signal. The voltage instruction signal HL is the High signal ("1"). The driver IC 140 receiving those signals inverts the voltage of the driving elements corresponding to the nozzle rows 40K, 40C, and 40M. Namely, the driver IC 140 receiving those signals makes the voltage of the driving elements corresponding to the nozzle rows 40K, 40C, and 40M the ground potential. The standby voltage of all the driving elements is kept at the driving potential.

In the output processing (exemplary second output processing) including the next strobe signal STB, all of the selection signals SIN0, 1, SIN2, 3, SIN4, 5, and SIN6, 7 are the High signals. The voltage instruction signal HL is the Low signal ("0"). The driver IC 140 receiving those signals inverts the voltage of the driving elements corresponding to the nozzle rows 40K, 40Y, 40C, and 40M. Namely, the driver IC 140 receiving those signals makes the voltage of the driving elements corresponding to the nozzle rows 40K, 40Y, 40C, and 40M the ground potential. The standby voltage of all the driving elements is kept at the ground potential. In that configuration, the voltage of the driving elements corresponding to the nozzle rows 40K, 40Y, 40C, and 40M is changed from the driving potential to the ground potential at different timings.

After the first switch processing (S32), the controller 130 performs the reset processing (S33). Specifically, the ASIC 135 generates 48×3-consecutive-bit High signals (i.e., the reset signal) consecutively from the 24×3-consecutive-bit Low signals, and outputs them to the SIN conversion circuit 141. Further, the ASIC 135 generates the non-inversion signals as the pattern signals FIRE0 and FIRE1 and outputs them to the FIRE0 conversion circuit 142 and FIRE1 conversion circuit 143, respectively. The SIN conversion circuit 141 receiving the reset signal synchronizes a signal inputted thereafter through the signal line 148 with the clock signal CLK, and extracts it as a new jetting instruction signal SIN. Namely, it is possible to allow the SIN conversion circuit 141 to recognize the beginning of a new jetting instruction signal SIN.

The voltage instruction signal HL is extracted as the ground potential by the consecutive Low signals outputted immediately before the reset signal. The reset signal includes a signal string of the strobe signals STB, and thus the control signals for the driving elements are generated by the selection signals SIN0, 1, SIN2, 3, SIN4, 5, and SIN6, 7 outputted from the SIN conversion circuit 141 in the reset processing. However, since the standby voltage of the driving elements is the ground potential and the pattern signals FIRE0 and FIRE 1 are the non-inversion signals, no driving elements are driven even when the selection signals SIN0, 1, SIN2, 3, SIN4, 5, and SIN6, 7 are outputted.

After the reset processing (S33), the controller 130 performs the second switch processing (S34) in which the ground potential of the driving elements kept as the standby voltage is changed to the driving potential in order of the nozzle rows 40Y, 40C, 40M, and 40K. Specifically, the ASIC 135 generates, as the jetting instruction signal SIN, the selection signals SIN0,1, SIN2, 3, SIN4, 5, and SIN6, 7 including the High signal or the Low signal, the strobe signals STB, and the voltage instruction signals HL, and serially outputs them to the SIN conversion circuit 141. This output includes four strobe signals STB for the respective nozzle rows 40K, 40Y, 40C, and 40M. The ASIC 135 generates, as the pattern signals FIRE0 and FIRE1, pulse signals indicating that an inversion potential is to be applied, and outputs them to the FIRE0 conversion circuit 142 and the FIRE1 conversion circuit 143.

In output processing (exemplary third output processing) including the first strobe signal STB, the selection signal SIN2, 3 is the High signal, and the selection signals SIN0, 1, SIN4, 5, and SIN6, 7 are the Low signals. The voltage instruction signal HL is the Low signal ("0"). The driver IC 140 receiving those signals inverts the voltage of the driving elements corresponding to the nozzle row 40Y. Namely, the driver IC 140 receiving those signals makes the voltage of the driving elements corresponding to the nozzle row 40Y the driving potential. The standby voltage of all the driving elements corresponding to the nozzle rows 40K, 40Y, 40C, and 40M is kept at the ground potential.

In the output processing including the next strobe signal STB, the selection signals SIN2, 3 and SIN4, 5 are the High signals, and the selection signals SIN0, 1 and SIN6, 7 are the Low signals. The voltage instruction signal HL is the Low signal ("0"). The driver IC 140 receiving those signals inverts the voltage of the driving elements corresponding to the nozzle rows 40Y and 40C. Namely, the driver IC 140 receiving those signals makes the voltage of the driving elements corresponding to the nozzle rows 40Y and 40C the driving potential. The standby voltage of all the driving elements corresponding to the nozzle rows 40K, 40Y, 40C, and 40M is kept at the ground potential.

In the output processing including the next strobe signal STB, the selection signals SIN2, 3, SIN4, 5, and SIN6, 7 are the High signals, and the selection signal SIN0, 1 is the Low signal. The voltage instruction signal HL is the Low signal ("0"). The driver IC 140 receiving those signals inverts the voltage of the driving elements corresponding to the nozzle rows 40Y, 40C, and 40M. Namely, the driver IC 140 receiving those signals makes the voltage of the driving elements corresponding to the nozzle rows 40Y, 40C, and 40M the driving potential. The standby voltage of all the driving elements corresponding to the nozzle rows 40K, 40Y, 40C, and 40M is kept at the ground potential.

In the output processing (exemplary fourth output processing) including the next strobe signal STB, all of the selection signals SIN0, 1, SIN2, 3, SIN4, 5, and SIN6, 7 are the High signals. The voltage instruction signal HL is the High signal ("1"). The driver IC 140 receiving those signals inverts the voltage of the driving elements corresponding to the nozzle rows 40K, 40Y, 40C, and 40M. Namely, the driver IC 140 receiving those signals makes the voltage of the driving elements corresponding to the nozzle rows 40K, 40Y, 40C, and 40M the driving potential. The standby voltage of all the driving elements corresponding to the nozzle rows 40K, 40Y, 40C, and 40M is kept at the driving potential. In that configuration, the voltage of the driving elements corresponding to the nozzle rows 40K, 40Y, 40C, and 40M is changed from the ground potential to the driving potential at different timings.

After the second switch processing (S34), the controller 130 changes the signal generation mode of the ASIC 135, from the reset mode to the jetting mode (S35). Then, the controller 130 performs flushing processing (S25). Specifically, the controller 130 controls the ASIC 135 to generate the jetting instruction signal SIN and pattern signals FIRE0 and FIRE1 for the purpose of flushing in which ink droplets are jetted from the respective nozzles 40 of the recording head 39, and the controller 130 controls the ASIC 135 to output them. The flushing may be performed such that jetting of ink droplets from the nozzle row 40K and jetting of ink droplets from the nozzle rows 40Y, 40C, and 40M are performed alternatingly and repeatedly, or such that ink droplets are jetted at the same time from all of the nozzle rows 40K, 40Y, 40C, and 40M.

After the flushing processing, the controller 130 drives the carriage motor 103 to move the carriage 23 to the recording start position (S26).

<Recording Processing>

Subsequently, the controller 130 performs recording processing (S12). In the recording processing, the controller 130 controls the recording head 39 to jet the ink at a predefined jetting timing while controlling the carriage motor 103 to move the carriage 23 in the left-right direction 9.

The controller 130 needs to cause the recording head 39 to jet ink from each nozzle 40 before each nozzle 40 of the recording head 39 arrives at a position immediately above each ink landing position in the sheet 12. The sheet 12 conveyed to the recording start position has the wave shape by the wave shape forming mechanism (see FIG. 7). Thus, the nozzle rows 40K, 40Y, 40C, and 40M have different amounts of flying time of ink droplets elapsing from the jetting thereof from the nozzles 40K, 40Y, 40C, and 40M to landing thereof on the sheet 12, depending on the respective distances between the nozzle rows 40K, 40Y, 40C, and 40M of the recording head 39 and the sheet 12 in the up-down direction 7. Consequently, the controller 130 needs to delay the jetting timing of ink from the nozzle 40, as the distance between the nozzle 40 and the landing position is shorter, that is, the flying time of ink is shorter. Further, the controller 130 needs to advance the jetting timing of ink from the nozzle 40, as the distance between the nozzle 40 and the landing position is longer, that is, the flying time of ink is longer.

Figure 16A:
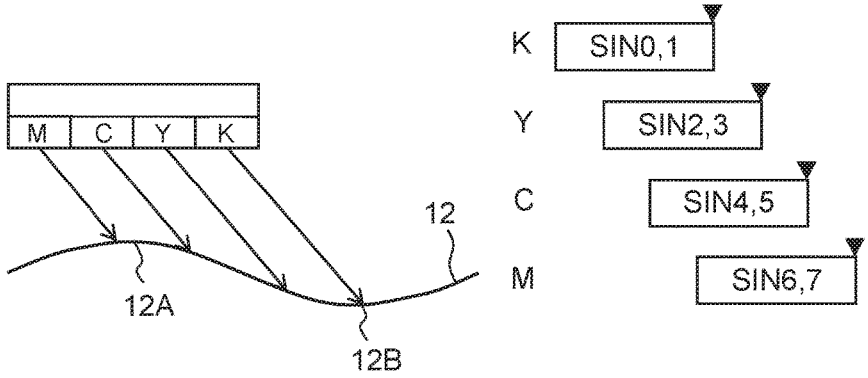
FIGS. 16A to 16C each schematically depicts selection signals SIN0 to SIN7 and a timing at which an ink droplet is jetted from each nozzle row on a wavy sheet.

For example, as depicted in FIG. 16A, the black ink lands in the vicinity of the concave portion 12B of the wavy sheet 12 and the magenta ink lands in the vicinity of the convex portion 12A of the wavy sheet 12, while the recording head 39 is being moved to the right. In that case, the jetting timing of the black ink is advanced relative to the case in which the sheet 12 has no wave shape, and the jetting timing of the magenta ink is delayed relative to the case in which the sheet 12 has no wave shape.

Figure 16B:
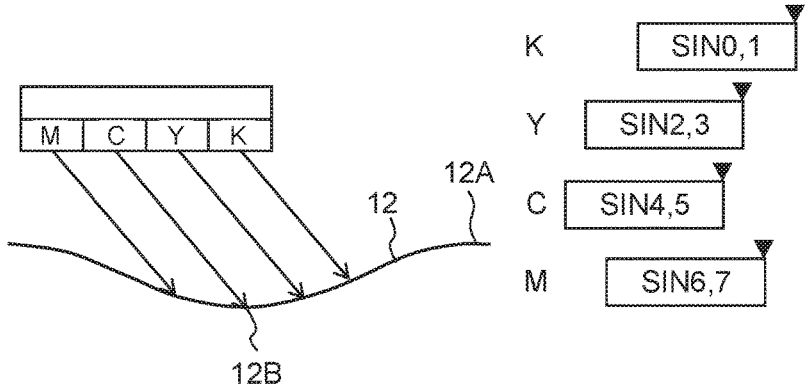

As depicted in FIG. 16B, the cyan ink lands in the vicinity of the concave portion 12B of the wavy sheet 12 while the recording head 39 is being moved to the right. In that case, the jetting timing of the cyan ink is advanced relative to the case in which the sheet 12 has no wave shape, and the jetting timings of remaining other color inks are delayed relative to the jetting timing of the cyan ink.

Figure 16C:
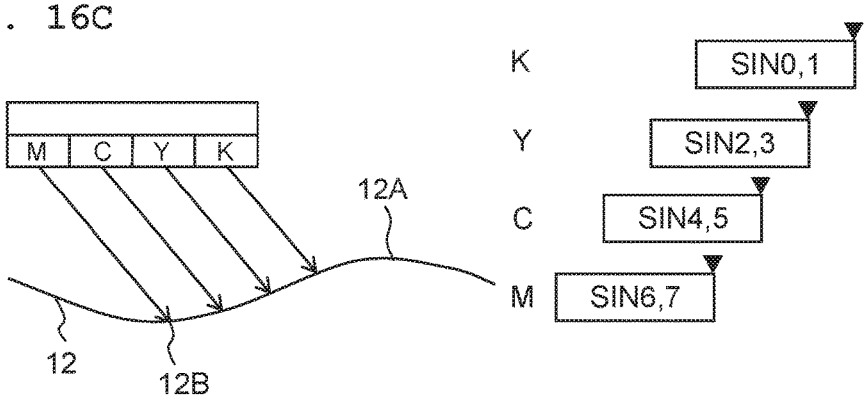

As depicted in FIG. 16C, the magenta ink lands in the vicinity of the concave portion 12B of the wavy sheet 12 while the recording head 39 is being moved to the right. In that case, the jetting timing of the magenta ink is advanced relative to the case in which the sheet 12 has no wave shape, and the jetting timings of remaining other color inks are delayed relative to the jetting timing of the magenta ink.

The controller 130 determines the jetting timing for each convex portion 12A and the jetting timing for each concave portion 12B to allow each of the inks to land on each of the portions 12A and 12B. Specifically, a shift amount of the convex portion 12A in the up-down direction 7 relative to the reference position of the sheet 12 having no wave shape and a shift amount of the concave portion 12B in the up-down direction 7 relative to the reference position are each divided by a moving velocity V of the carriage 23, thereby making it possible to obtain the time required to move the carriage 23 the distance corresponding to the shift amount. Alternatively, the controller 130 may estimate flying times of the inks jetted from the nozzle rows 40K, 40Y, 40C, and 40M, respectively, based on positions of the nozzle rows 40K, 40Y, 40C, and 40M in the recording head 39 relative to the left-right direction 9 and information relating to the wave shape of the sheet 12. Shifting the jetting timing from a corresponding reference value based on the obtained time allows each of the inks to land on each of the portions 12A and 12B. Information for the calculation may be stored, for example, in the EEPROM in advance.

For example, as depicted in FIG. 16A, when the ink is jetted in order of the black ink, yellow ink, cyan ink, and magenta ink, the ASIC 135 causes the selection signals SIN2,3, SIN4, 5, and SIN6, 7 included in the jetting instruction signal SIN to include the Low signal, thereby making the timings at which the driving elements corresponding to the nozzle rows 40K, 40Y, 40C, and 40M are driven, different from each other. Specifically, as depicted in FIG. 12, a signal corresponding to a row "A" of columns "SIN2" and "SIN3" is determined as the Low signal, a signal corresponding to rows "A" and "B" of columns "SIN4" and "SIN5" is determined as the Low signal, and a signal corresponding to rows "A", "B", and "C" of columns "SIN6" and "SIN7" is determined as the Low signal. Accordingly, ink droplets can be jetted at the timings in order of the nozzle rows 40K, 40Y, 40C, and 40M.

Ink droplets are selectively jetted from the nozzles 40 of the recording head 39 moving in the left-right direction 9 on the sheet 12 of which conveyance is being stopped. In that situation, as described above, the jetting timings of ink droplets jetted from the nozzle rows 40K, 40Y, 40C, and 40M are adjusted depending on the wave shape of the sheet 12. Accordingly, image recording corresponding to one pass is performed on the sheet 12.

Next, when the image recording corresponding to one pass performed most recently is not the image recording corresponding to the last pass (S13: No), the controller 130 performs conveyance processing in which the sheet 12 is conveyed in the conveyance direction 16 by a predefined line feed width (S14). Specifically, the controller 130 rotates the conveyance motor 102 by a predefined number of rotations, thus conveying the sheet 12 with at least one of the conveyance roller unit 54 and the discharge roller unit 55 by the predefined line feed width. As a result, the area of the sheet 12 for which image recording is to be performed in the next pass faces the recording head 39.

The controller 130 repeatedly performs the processing from the step S12 to the step S14 until the image recording corresponding to one pass for the sheet 12 is the image recording corresponding to the last pass (S13: Yes). When the image recording corresponding to the last pass for the sheet 12 has been completed (S13: Yes), the controller 130 performs discharge processing in which the sheet 12 is discharged on the discharge tray 21 (S15). Specifically, the controller 130 rotates the conveyance motor 102 by a predefined number of rotations, thereby discharging the sheet 12 with the discharge roller unit 55.

When the printing data includes data for the next page (S16: Yes), the controller 130 performs image recording for the next page by performing the recording preparation processing (S11) as described above and then performing the recording processing (S12) and the conveyance processing (S14) repeatedly. When the printing data includes no data for the next page (S16: No), the controller 130 ends the image recording.

<Noise Influence>

Figure 17A:
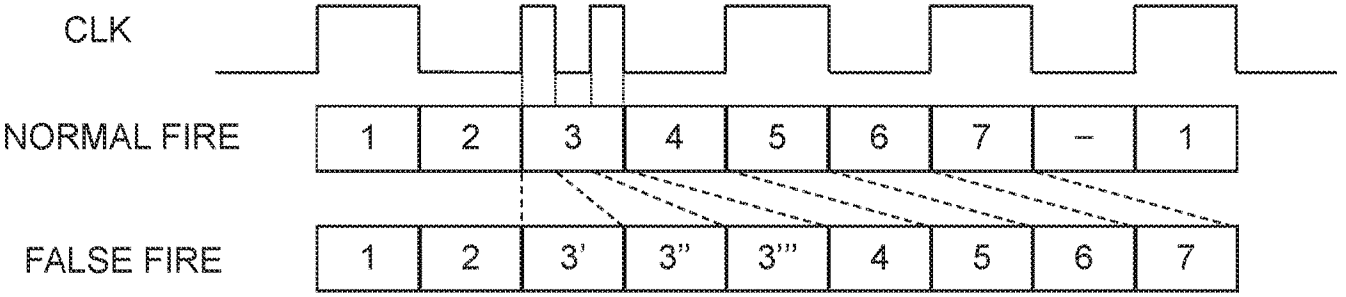
FIGS. 17A and 17B each schematically depicts an exemplary pattern signal FIRE generated when noise is superimposed on the clock signal CLK.
Figure 17B:
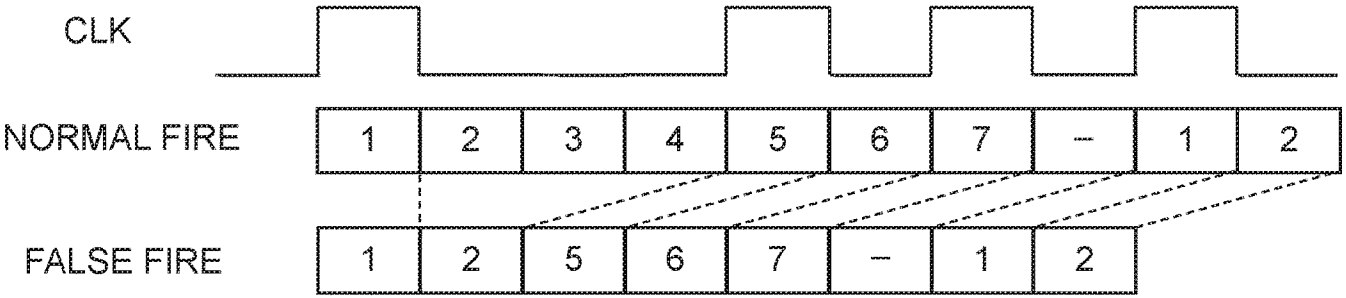

When radiation noise or the like occurs in the flexible flat cable connecting the controller 130 and the driver IC 140, as depicted in FIG. 17A, an unnecessary pulse rise may be caused, for example, in the clock signal CLK. Or, as depicted in FIG. 17B, the pulse of the clock signal CLK may partially disappear. As a result, for example, in the pattern signal FIRE0 extracted in synchronization with the clock signal CLK in the FIRE0 conversion circuit 142, the same driving waveform may continue or a necessary driving waveform may disappear. This causes the multiplexer 146 to select a driving waveform that is different from the driving waveform supposed to be selected and to output it to the boosting buffer 147. As a result, the driving elements supposed to be driven based on the printing data may not be driven, which may make an image to be recorded on the sheet 12 imperfect.

In this embodiment, as described above, the reset processing (S33) is performed in the recording preparation processing (S11) in which each sheet 12 is fed from the feed tray 20. Thus, even when the noise causes any imperfection in the image recorded on the previous sheet 12, image recording for the subsequent sheet 12 is performed correctly.

[Function and Effect of Embodiment]

In this embodiment, the jetting timings of inks from the nozzle rows 40K, 40Y, 40C, and 40M may be controlled individually by use of the strobe signals STB corresponding to the nozzle rows 40K, 40Y, 40C, and 40M respectively. Thus, for example, even when the amounts of flying time of inks elapsing from jetting thereof from the nozzle rows 40K, 40Y, 40C, and 40M to landing thereof on the sheet 12 are different from each other, the inks may be jetted from the nozzle rows 40K, 40Y, 40C, and 40M respectively at proper timings.

The reset processing (S33) is performed at a timing between the image recording for the respective sheets 12. This allows the jetting timings of inks to be controlled individually by use of the strobe signals STB for the nozzle rows 40K, 40Y, 40C, and 40M respectively, and allows the SIN conversion circuit 141 to recognize a new jetting instruction signal SIN. Namely, it is possible to allow the SIN conversion circuit 141 to recognize the beginning of a new jetting instruction signal SIN.

When the reset processing (S33) is performed, the recording head 39 faces the waste ink tray 47. Thus, for example, even when the ink droplet is erroneously jetted from the nozzle 40 in the reset processing (S33) and the second switch processing (S34), the ink droplet erroneously jetted lands in the waste ink tray 47. Accordingly, the multifunctional peripheral 10 and the sheet 12 are prevented from being contaminated. Specifically, the reset signal including the strobe signals STB may cause the driver IC 140 to apply the driving voltage to the driving element. If the selection signals SIN0 to SIN7 and the pattern signals FIRE0 and FIRE 1 cannot be extracted properly due to the superimposition of noise on the clock signal CLK and the like, the ink droplet could be jetted erroneously from the nozzle 40. Further, in the second switch processing (S34), the standby voltage of each driving element is changed from the ground potential to the driving potential sequentially, which decreases the volume of each pressure chamber 29. As a result, the ink could be jetted from the corresponding nozzle 40 by an amount corresponding to the decrease in volume of each pressure chamber 29. Such ink droplets land in the waste ink tray 47.

The flushing processing (S25) is performed after the reset processing (S33). Thus, the ink dried in each nozzle 40 is discharged properly, thus preventing the next recording processing from having deteriorated image recording quality.

The reset processing (S33) is performed in a state where the standby voltage of the driving elements is kept at the ground potential. This prevents the ink from being erroneously jetted in the reset processing (S33).

In the first switch processing (S32), the nozzle rows 40K, 40Y, 40C, and 40M have mutually different timings at which the voltage of the driving elements corresponding to the respective nozzle rows is decreased, and thus the damage on the driver IC 140 may be reduced. Further, in the second switch processing (S34), the nozzle rows 40K, 40Y, 40C, and 40M have mutually different timings at which the voltage of the driving elements corresponding to the respective nozzle rows is increased, and thus the load on a power circuit may be distributed.

In the reset processing (S33), only the non-inversion signal is outputted as the pattern signals FIRE0 and FIRE 1. Thus, even when the signal can not be extracted properly due to the superimposition of noise on the clock signal CLK and the like, the ink is prevented from being erroneously jetted in the reset processing (S33).

Modified Embodiments

Although the reset processing (S33) is performed in the recording preparation processing (S11) for each sheet 12 in the above embodiment, the reset processing (S33) may be performed at least at a timing between the recording processing performed twice successively (S12). Thus, no reset processing (S33) may be performed in the recording preparation processing (S11) for the first sheet 12, and the reset processing (S33) may be performed in the recording preparation processing (S11) for the second or later sheet 12.

It is not indispensable to perform the reset processing in the record preparation processing. The reset processing may be performed in parallel with the processing in which the sheet 12 is discharged (S15). The reset processing (S33) may be performed during the recording processing (S12) corresponding to one pass. The reset processing (S33) may be performed at a timing at which the recording processing (S12) corresponding to one pass ends by allowing the controller 130 to monitor whether predefined time has elapsed since the reset processing (S33) performed most recently. The reset processing (S33) may be performed at a timing at which the flushing processing is performed.

In the above embodiment, inks of four colors of black, yellow, cyan, and magenta are jetted as ink droplets from the nozzle rows 40K, 40Y, 40C, and 40M, respectively. The present teaching is not limited thereto. The present teaching may be applicable to any configuration including at least nozzles 40 belonging to a first group and nozzles 40 belonging to a second group, wherein piezoelectric actuators 90 are provided for the respective groups. These groups may not be limited to those classified based on colors of inks, and the groups may be classified based on, for example, difference in ink compositions or viscosity, such as pigment inks and dye inks.

What is claimed is:

1. An ink-jet recording apparatus, comprising:

a conveyor configured to convey a sheet in a conveyance direction, a recording head including first nozzles, second nozzles, first driving elements corresponding to the first nozzles respectively, and second driving elements corresponding to the second nozzles respectively;

a controller; and a head driving circuit connected to the controller by a first signal line, a second signal line, and a third signal line through which a clock signal is transmitted, the head driving circuit connected electrically to the first driving elements and the second driving elements, wherein each of the first driving elements is configured to be driven to jet an ink droplet from one of the first nozzles corresponding thereto in a case that driving voltage is applied from the head driving circuit to each of the first driving elements, each of the second driving elements is configured to be driven to jet an ink droplet from one of the second nozzles corresponding thereto in a case that driving voltage is applied from the head driving circuit to each of the second driving elements, the controller is configured to repeatedly execute conveyance processing and recording processing, the conveyance processing being processing in which the sheet is conveyed with the conveyor in a state where an area of the sheet for which the image is to be recorded faces the recording head, the recording processing being processing in which pattern signals indicating patterns of the driving voltage are outputted serially to the first signal line in synchronization with the clock signal and a jetting instruction signal is outputted serially to the second signal line in synchronization with the clock signal, in a case that the recording processing is executed multiple times, the controller is configured to execute reset processing at least once, the reset processing being processing in which a reset signal indicating a beginning of a new jetting instruction signal is outputted to the second signal line, the reset processing being executed between the recording processing executed twice successively, the jetting instruction signal includes first selection signals corresponding to the first driving elements respectively, second selection signals corresponding to the second driving elements respectively, a first output signal, and a second output signal, each of the first selection signals is used to select, from among the pattern signals, the driving voltage to be applied to the corresponding first driving element, each of the second selection signals is used to select, from among the pattern signals, the driving voltage to be applied to the corresponding second driving element, the first output signal indicates a timing at which the driving voltage is outputted to the first driving elements, the second output signal indicates a timing at which the driving voltage is outputted to the second driving elements, the head driving circuit is configured to repeatedly execute first extraction processing, second extraction processing, first application processing, and second application processing, the first extraction processing being processing in which the pattern signals inputted through the first signal line are extracted in response to the clock signal inputted through the third signal line;

the second extraction processing being processing in which the first selection signals, the second selection signals, the first output signal, the second output signal, and the reset signal inputted through the second signal line are extracted in response to the clock signal inputted through the third signal line;

the first application processing being processing in which, after extracting the first output signal, the driving voltage selected based on the first selection signals is applied in parallel to the first driving elements corresponding thereto, the second application processing being processing in which, after extracting the second output signal, the driving voltage selected based on the second selection signals is applied in parallel to the second driving elements corresponding thereto, and in the second extraction processing, the head driving circuit is configured to extract a signal inputted through the second signal line subsequent to the reset signal, as the beginning of the new jetting instruction signal.

2. The ink-jet recording apparatus according to claim 1, wherein the controller is configured to execute discharge processing after repeatedly executing the conveyance processing and the recording processing for a first sheet, the discharge processing being processing in which the first sheet at a position facing the recording head is discharged by use of the conveyor, the controller is configured to repeatedly execute the conveyance processing and the recording processing for a second sheet which is subsequent to the first sheet, after executing the discharge processing, and the controller is configured to execute the first-time conveyance processing for the second sheet in parallel with the reset processing.

3. The ink-jet recording apparatus according to claim 2, further comprising: a carriage carrying the recording head and configured to move the recording head in a main scanning direction intersecting with the conveyance direction; and an ink receiver arranged on an outside of a sheet-facing area in the main scanning direction and configured to receive ink droplets jetted from the first nozzles and the second nozzles, the sheet-facing area being an area where the recording head faces the sheet, wherein the reset signal includes signal patterns of the first output signal and the second output signal, and the controller is configured to execute movement processing, in which the carriage is moved to a position where the recording head faces the ink receiver, before the reset processing.

4. The ink-jet recording apparatus according to claim 3, wherein the controller is configured to execute flushing processing in which the ink droplets are jetted from the first nozzles and the second nozzles to the ink receiver in response to completion of the reset processing.

5. The ink-jet recording apparatus according to claim 3, wherein the first nozzles and the second nozzles are arranged in the recording head to be separated from each other in the main scanning direction.

6. The ink-jet recording apparatus according to claim 1, wherein the controller is configured to execute subsequent reset processing in a case that predefined time has elapsed since the reset processing and that a single execution of the recording processing, among multiple execution of the recording processing, has completed.

7. The ink-jet recording apparatus according to claim 1, wherein the recording head further includes pressure chambers communicating with the first nozzles and the second nozzles respectively, and each of the pressure chambers is capable of storing the ink, each of the first driving elements and the second driving elements is a driving element configured to keep the pressure chamber corresponding thereto a first volume in a case that first voltage is being applied, and to cause the pressure chamber corresponding thereto to swell and have a second volume larger than the first volume in a case that second voltage smaller than the first voltage is being applied, each of the pattern signals indicates a timing and time at which the second voltage is applied to the driving element of which standby voltage is kept at the first voltage, the controller is configured to execute first switch processing, in which the standby voltage of the driving element is switched from the first voltage to the second voltage, before the reset processing, and the controller is configured to execute second switch processing, in which the standby voltage of the driving element is switched from the second voltage to the first voltage, after the reset processing.

8. The ink-jet recording apparatus according to claim 7, wherein, in the first switch processing, the controller is configured to switch the standby voltage from the first voltage to the second voltage in a state where the second voltage is applied to one of the first driving elements and the second driving elements, and in the second switch processing, the controller is configured to switch the standby voltage from the second voltage to the first voltage in a state where the second voltage is applied to the other of the first driving elements and the second driving elements.

9. The ink-jet recording apparatus according to claim 8, wherein, in the first switch processing, the controller is configured to execute first output processing and second output processing in order while continuously outputting, to the first signal line as the pattern signals, an inversion signal indicating a pattern by which voltage to be applied to the driving element is inverted from one of the first voltage and the second voltage to the other of the first voltage and the second voltage, the first output processing being processing in which the first selection signals each having a first value set therefor, the second selection signals each having a second value set therefor, the first output signal, the second output signal, and a voltage instruction signal having a third value set therefor are outputted to the second signal line, the second output processing being processing in which the first selection signals each having the first value set therefor, the second selection signals each having the first value set therefor, the first output signal, the second output signal, and the voltage instruction signal having a fourth value set therefor are outputted to the second signal line, the first value indicates that the driving voltage is applied to the driving element, the second value indicates that no driving voltage is applied to the driving element, the third value indicates that the standby voltage is the first voltage, the fourth value indicates that the standby voltage is the second voltage, and in the second switch processing, the controller is configured to execute third output processing and fourth output processing in order while continuously outputting the inversion signal to the first signal line as the pattern signals, the third output processing being processing in which the first selection signals each having the second value set therefor, the second selection signals each having the first value set therefor, the first output signal, the second output signal, and the voltage instruction signal having the fourth value set therefor are outputted to the second signal line, the fourth output processing being processing in which the first selection signals each having the first value set therefor, the second selection signals each having the first value set therefor, the first output signal, the second output signal, and the voltage instruction signal having the third value set therefor are outputted to the second signal line.

10. The ink-jet recording apparatus according to claim 9, wherein, in the reset processing, the controller is configured to output, to the first signal line as the pattern signals, a non-inversion signal indicating a pattern by which the standby voltage is maintained, and to output, to the second signal line, the reset signal in which the first value continues.

11. The ink-jet recording apparatus according to claim 1, wherein the jetting instruction signal includes first signal areas and second signal areas alternately, the first selection signals are arranged in each of the first signal areas, the second selection signals are arranged in each of the second signal areas, each of the first selection signals has a signal length which is 1/N (N is a natural number) of each of the first signal areas, each of the second selection signals has a signal length which is 1/N of each of the second signal areas, the first output signal has a signal length which is M times each first signal area and is one of first output signals arranged to be distributed in the first signal areas, the second output signal has a signal length which is M times each second signal area and is one of second output signals arranged to be distributed in the second signal areas, the reset signal is a continuous signal including signal pattern configured by the first output signal and the second output signal, the head driving circuit is configured by:

a first conversion circuit configured to execute the first extraction processing;

a second conversion circuit configured to execute a part of the second extraction processing;

a first output circuit configured to execute a part of the second extraction processing and the first application processing; and a second output circuit configured to execute a part of the second extraction processing and the second application processing, in the first extraction processing, the first conversion circuit is configured to output the pattern signals extracted, in parallel, to the first output circuit and the second output circuit, in the second extraction processing, the second conversion circuit is configured to extract the reset signal from among the signals inputted through the second signal line, to extract a signal next to the reset signal as the beginning of the new jetting instruction signal, to output a signal in the first signal area to the first output circuit, and to output a signal in the second signal area next to the first signal area to the second output circuit, in the second extraction processing, the first output circuit is configured to extract the first selection signals and the first output signal, in the first application processing, the first output circuit is configured to select one of the pattern signals for each first selection signal and to apply the driving voltage indicated by the pattern signal selected to the first driving element corresponding thereto, in the second extraction processing, the second output circuit is configured to extract the second selection signals and the second output signal, and in the second application processing, the second output circuit is configured to select one of the pattern signals for each second selection signal and to apply the driving voltage indicated by the pattern signal selected to the second driving element corresponding thereto.

12. The ink-jet recording apparatus according to claim 1, further comprising: a carriage carrying the recording head and configured to move the recording head in a main scanning direction intersecting with the conveyance direction; and a wave shape forming mechanism configured to make an area of the sheet to be opposed to the recording head a shape in which at least one concave portion and at least one convex portion are formed alternately in the main scanning direction, the at least one convex portion is a portion at which a distance between the recording head and the sheet changes from decrease to increase, the at least one concave portion is a portion at which the distance between the recording head and the sheet changes from increase to decrease, the first nozzles and the second nozzles are arranged in the recording head to be separated from each other in the main scanning direction, in the recording processing, the controller is configured to output the pattern signals to the first signal line and to output the jetting instruction signal to the second signal line while moving the carriage in the main scanning direction.

13. The ink-jet recording apparatus according to claim 1, wherein the reset signal has a signal length which is longer than those of the first output signal and the second output signal.

* * * * *